US006446602B1

(12) United States Patent
Yonezawa et al.

(10) Patent No.: US 6,446,602 B1
(45) Date of Patent: Sep. 10, 2002

(54) CYLINDER IDENTIFYING SYSTEM FOR INTERNAL COMBUSTION ENGINE

(75) Inventors: Shiro Yonezawa; Atsuko Hashimoto; Hirofumi Ohuchi, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/838,256

(22) Filed: Apr. 20, 2001

(30) Foreign Application Priority Data

Oct. 27, 2000 (JP) ..... 2000-328526

(51) Int. Cl.[7] ..... F02D 45/00; F02D 41/02
(52) U.S. Cl. ..... 123/406.62; 123/406.18
(58) Field of Search ..... 123/406.61, 406.62, 123/406.63, 406.18, 406.58

(56) References Cited

U.S. PATENT DOCUMENTS 4,351,307 A * 9/1982 Komurasaki et al. .. 123/406.61
4,385,605 A * 5/1983 Petrie et al. ..... 123/406.61
5,156,125 A * 10/1992 Fukui et al. ..... 123/406.62
5,343,842 A * 9/1994 Fukui et al. ..... 123/406.62
5,497,249 A * 3/1996 Kim ..... 123/406.63
5,630,396 A * 5/1997 Fukui et al. ..... 123/406.18
5,794,592 A * 8/1998 Fukui ..... 123/406.62
6,016,789 A * 1/2000 Denz et al. ..... 123/406.62

FOREIGN PATENT DOCUMENTS

JP 7-224620 8/1995

* cited by examiner

*Primary Examiner*—Paul J. Hirsch
(74) *Attorney, Agent, or Firm*—Sughrue Mion, PLLC

(57) ABSTRACT

A cylinder identifying system for an internal combustion engine capable of establishing a complicated cam signal pulse pattern without need for setting specific periods for cylinder identification while enhancing control performance by reducing a crank rotation angle required for cylinder identification. A cylinder identifying means (10) for identifying discriminatively individual cylinders on the basis of a crank angle pulse signal (SGT) and a cam pulse signal (SGC) includes a pulse signal number storage means (12) for counting for storage signal numbers of specific pulses generated over a plurality of subperiods which are defined by dividing an ignition control period for each of the individual cylinders into plural subperiods, and an information series storage means (15) for storing information series each composed of a combination of the signal numbers generated during plural subperiods, respectively. The individual cylinders are identified on the basis of the information series.

13 Claims, 23 Drawing Sheets

FIG. 3

| | | | | |
|---|---|---|---|---|
| (a) | 1 | 2 | 0 | 0 |
| (b) | 0 | 1 | 2 | 1 |
| | #1 | #3 | #4 | #2 |

FIG. 4

| | | | | |
|---|---|---|---|---|
| (a) | 1 | 0 | 1 | 2 |
| (b) | 1 | 2 | 0 | 0 |
| | #1 | #3 | #4 | #2 |

FIG. 6

| | | | | | | | | |
|---|---|---|---|---|---|---|---|---|
| S_cam (n-3) | 0 | 1 | 1 | 0 | 2 | 1 | 0 | 2 |
| S_cam (n-2) | 1 | 1 | 0 | 2 | 1 | 0 | 2 | 0 |
| S_cam (n-1) | 1 | 0 | 2 | 1 | 0 | 2 | 0 | 1 |
| S_cam (n) | 0 | 2 | 1 | 0 | 2 | 0 | 1 | 1 |
| Cyld (n) | CYLINDER #1 | | CYLINDER #3 | | CYLINDER #4 | | CYLINDER #2 | |
| Cylp (n) | CYLINDER #3 | | CYLINDER #4 | | CYLINDER #2 | | CYLINDER #1 | |

FIG. 14

| | #1 | #3 | #4 | #2 |
|---|---|---|---|---|
| S_cam (n-1) | 1 | 0 | 0 | 0 |
| S_cam (n) | 1 | 2 | 2 | 1 |

FIG. 15

| | a1 | a2 | b1 | b2 | c1 | c2 | d1 | d2 |
|---|---|---|---|---|---|---|---|---|
| S_cam (n-3) | 2 | 0 | 1 | 1 | 2 | 1 | 0 | 2 |
| S_cam (n-2) | 0 | 1 | 1 | 0 | 1 | 0 | 2 | 0 |
| S_cam (n-1) | 1 | 1 | 0 | 2 | 0 | 2 | 0 | 1 |
| S_cam (n) | 1 | 0 | 2 | 1 | 2 | 0 | 1 | 1 |
| Cyld (n) | CYLINDER #1 | | CYLINDER #3 | | CYLINDER #4 | | CYLINDER #2 | |
| Cylp (n) | CYLINDER #3 | | CYLINDER #4 | | CYLINDER #2 | | CYLINDER #1 | |

FIG. 18

| | #1 | #3 | #4 | #2 |
|---|---|---|---|---|
| S_cam (n-1) | 1 | 2 | 0 | 0 |
| S_cam (n) | 0 | 1 | 2 | 1 |

FIG. 19

| | a1 | a2 | b1 | b2 | c1 | c2 | d1 | d2 |
|---|---|---|---|---|---|---|---|---|
| S_cam (n-3) | 0 | 1 | 1 | 0 | 2 | 1 | 0 | 2 |
| S_cam (n-2) | 1 | 1 | 0 | 2 | 1 | 0 | 2 | 0 |
| S_cam (n-1) | 1 | 0 | 2 | 1 | 0 | 2 | 0 | 1 |
| S_cam (n) | 0 | 2 | 1 | 0 | 2 | 0 | 1 | 1 |
| Cyld (n) | CYLINDER #1 | | CYLINDER #3 | | CYLINDER #4 | | CYLINDER #2 | |
| Cylp (n) | CYLINDER #3 | | CYLINDER #4 | | CYLINDER #2 | | CYLINDER #1 | |

FIG. 22

| | | | | | | |
|---|---|---|---|---|---|---|
| (a) | 0 | 1 | 2 | 1 | 0 | 1 |
| (b) | 1 | 0 | 0 | 2 | 2 | 1 |
| | #1 | #2 | #3 | #4 | #5 | #6 |

FIG. 23

| | #1 | #2 | #3 | #4 | #5 | #6 |
|---|---|---|---|---|---|---|
| S_cam (n-1) | 0 | 1 | 2 | 1 | 0 | 1 |
| S_cam (n) | 1 | 0 | 0 | 2 | 2 | 1 |

FIG. 24

| | a1 | a2 | b1 | b2 | c1 | c2 | d1 | d2 | e1 | e2 | f1 | f2 |
|---|---|---|---|---|---|---|---|---|---|---|---|---|
| S_cam (n-3) | 1 | 1 | 0 | 1 | 1 | 0 | 2 | 0 | 1 | 2 | 0 | 2 |
| S_cam (n-2) | 1 | 0 | 1 | 1 | 0 | 2 | 0 | 1 | 2 | 0 | 2 | 1 |
| S_cam (n-1) | 0 | 1 | 1 | 0 | 2 | 0 | 1 | 2 | 0 | 2 | 1 | 1 |
| S_cam (n) | 1 | 1 | 0 | 2 | 0 | 1 | 2 | 0 | 2 | 1 | 1 | 0 |

| | | | | | | |
|---|---|---|---|---|---|---|
| Cyld (n) | CYLINDER #1 | CYLINDER #2 | CYLINDER #3 | CYLINDER #4 | CYLINDER #5 | CYLINDER #6 |
| Cylp (n) | CYLINDER #2 | CYLINDER #3 | CYLINDER #4 | CYLINDER #5 | CYLINDER #6 | CYLINDER #1 |

FIG. 26

| | | | | | | |
|---|---|---|---|---|---|---|
| (a) | 0 | 1 | 2 | 1 | 0 | 1 |
| (b) | 1 | 0 | 0 | 2 | 2 | 1 |
| | B125 | B05 | B125 | B05 | B125 | B05 |
| | #1 | | #3 | | #2 | |

FIG. 27

| | #1 | | #3 | | #2 | |
|---|---|---|---|---|---|---|
| | B125 | B05 | B125 | B05 | B125 | B05 |
| S_cam (n-1) | 0 | 1 | 2 | 1 | 0 | 1 |
| S_cam (n) | 1 | 0 | 0 | 2 | 2 | 1 |

FIG. 28

| | a1 | a2 | b1 | b2 | c1 | c2 |
|---|---|---|---|---|---|---|
| S_cam (n-3) | 0 | 1 | 2 | 0 | 0 | 2 |
| S_cam (n-2) | 1 | 1 | 0 | 1 | 2 | 1 |
| S_cam (n-1) | 1 | 0 | 1 | 2 | 1 | 1 |
| S_cam (n) | 0 | 2 | 2 | 0 | 1 | 0 |
| Cyld (n) | CYLINDER #1 | | CYLINDER #3 | | CYLINDER #2 | |
| Cylp (n) | CYLINDER #3 | | CYLINDER #2 | | CYLINDER #1 | |

CYLINDER IDENTIFYING SYSTEM FOR INTERNAL COMBUSTION ENGINE

BACKGROUND OF THE INVENTION

1. Field of the Invention

The present invention generally relates to a cylinder identifying system for an internal combustion engine mounted on an automobile or a motor vehicle. More particularly, the present invention is concerned with a cylinder identifying system for an internal combustion engine which system is designed for identifying discriminatively individual cylinders of the internal combustion engine within a short time even upon starting of the engine operation and changing of valve timing for thereby enhancing control performance.

2. Description of Related Art

As the hitherto known or conventional cylinder identifying system using, for example, a crank angle pulse signal and a cam pulse signal in the internal combustion engine which is equipped with a variable valve timing mechanism (hereinafter also referred to as the VVT mechanism), there may be mentioned the one which is disclosed, for example, in Japanese Unexamined Patent Application Publication No. 224620/1995 (JP-A-7-224620).

In the cylinder identifying system described in the publication mentioned above, a reference position given in terms of the a crank angle is detected on the basis of a crank angle pulse signal containing a reference signal. A given or specific cylinder can be determined discriminatively or identified by detecting presence/absence of a cam signal pulse in a particular or specific period succeeding to the detection of the reference position.

In this case, the cam signal pulse for cylinder identification is so set as to be generated or outputted three times for one rotation of a cam shaft (corresponding to two rotations of a crank shaft) in consideration of the controllability of the variable valve timing for the reason described below.

When the number of times the cam signal pulse is outputted is set to once for two rotations of the crank shaft, the VVT signal phase can be detected only once during two revolutions of the engine, incurring degradation of phase control performance of the VVT mechanism.

On the other hand, when the number of times the cam signal pulses are outputted is set to four times or more for two revolutions of the engine, deviation in the angular position of the cam pulse signal relative to the crank angle pulse signal will take place under the influence of change of the valve drive timing phase variable range due to the variable valve timing control, which incurs erroneous identification of the cylinder, to great disadvantage.

More specifically, in the conventional cylinder identifying system described in the above publication, when the valve drive timing phase changes due to the variable valve timing control, the cylinder identification is performed within a specific angular range of the crank angle pulse signal. Thus, a cam signal pattern for the cylinder identification is of a relatively simple structure.

However, in the cylinder identification, presence or absence of the cam signal pulse is determined discriminatively after detection of the reference signal from the crank angle pulse signal. Accordingly, when the detection of the crank angle pulse signal is started immediately after the detection of the reference signal, the reference signal can not be detected (i.e., the cylinder identification can not be started, to say in another way) without detecting the crank angle pulse signal after about one revolution of the engine.

As will now be understood from the foregoing description, in the conventional cylinder identifying system for the internal combustion engine, the cylinder identification is performed within a predetermined range of crank angle without taking into account the change of the cam pulse signal phase brought about through the variable valve timing control. Further, the cylinder identification is performed after detection of the reference signal on the basis of presence/absence of the cam pulse signal by referencing a relatively simple cam signal pulse pattern. Consequently, in the worst case where the signal detection is started immediately succeeding to the reference signal, one or more revolutions of the engine is required for completing the cylinder identification, giving rise to a problem that the engine control performance will be degraded.

SUMMARY OF THE INVENTION

In the light of the state of the art described above, it is an object of the present invention to provide a cylinder identifying system for an internal combustion engine which system is capable of establishing a complicated cam signal pattern without need for setting any particular or specific periods for the purpose of cylinder identification for thereby enhancing the engine control performance by reducing a engine revolution quantity required for the cylinder identification.

In view of the above and other objects which will become apparent as the description proceeds, there is provided according to a general aspect of the present invention a cylinder identifying system for an internal combustion engine, which system includes a crank angle signal generating means provided in association with a crank shaft of the internal combustion engine for generating a crank angle pulse signal in synchronization with rotation of the crank shaft of the engine, a cam signal generating means provided in association with a cam shaft for generating a cam pulse signal containing specific pulses for identifying individual cylinders of the internal combustion engine in synchronization with rotation of the cam shaft rotating at a speed corresponding to one half of that of the crank shaft, a variable valve timing means for setting variably phase of valve drive timing for the individual cylinders, respectively, in dependence on operating states of the engine, and a cylinder identifying means designed for operating in synchronization with the phase of the valve drive timing for the individual cylinders which is changed by the variable valve timing means, for thereby identifying discriminatively the individual cylinders on the basis of the crank angle pulse signal and the cam pulse signal. In the cylinder identifying system mentioned above, the cylinder identifying means is comprised of a pulse signal number storage means for counting for storage signal numbers of the specific pulses generated over a plurality of subperiods which are defined by dividing an ignition control period for each of the individual cylinders into plural subperiods, and an information series storage means for storing information series composed of a combination of the signal numbers of the specific phases generated during the plural subperiods, respectively, wherein the individual cylinders of the internal combustion engine are identified on the basis of the information series.

By virtue of the arrangement described above, there is provided for an internal combustion engine the cylinder identifying system which is capable of setting a complicated cam pulse signal patterns without need for establishing any particular periods for the cylinder identification and which can decrease the angle of rotation required for the cylinder identification, to thereby allow the engine controllability to be enhanced and improved significantly.

In a preferred mode for carrying out the invention, the information series may be composed of four successive signals containing the specific pulses.

Owing to the feature described above, the angle of rotation required for the cylinder identification can be decreased, whereby the engine operation controllability can be enhanced.

In another preferred mode for carrying out the invention, the information series storage means may be so designed as to store a plurality of information series which are variable within a range in which the phase of the valve drive timing is changed by the variable valve timing means. The cylinder identifying means may preferably be so designed as to identify a given one of the cylinders on the basis of at least one of the plural information series.

With the arrangement described above, even when the phase of the cam pulse signal is advanced due to the variable valve timing control, the angle of rotation required for the cylinder identification can be decreased, whereby the engine operation controllability can be enhanced.

In yet another preferred mode for carrying out the invention, the cylinder identifying means may be comprised of an information series learning means for learning a first one of the information series at a predetermined crank angle based on the crank angle pulse signal, wherein the cylinder identifying means may be so arranged as to identify the individual cylinders on the basis of a result of comparison of the information series detected currently with the first information series learned.

In still another preferred mode for carrying out the invention, the cylinder identifying means may be comprised of a changeable information series arithmetic means for determining arithmetically a second one of the information series which can vary within a range of the predetermined crank angle on the basis of the first information series and the range within which the phase of the valve drive timing can be changed by means of the variable valve timing means, wherein the cylinder identifying means is so arranged as to identify the individual cylinders, respectively, on the basis of result of comparison between the information series detected currently and at least one of the first and second information series.

In a further preferred mode for carrying out the invention, the information series learning means may be so arranged as to learn the first information series at a time point which corresponds to at least one of a most retarded valve drive timing and a most advanced valve drive timing set by the variable valve timing means.

In a yet further preferred mode for carrying out the invention, the information series learning means may be so arranged as to learn the first information series at a time point at which operation of the internal combustion engine is started.

Owing to the arrangements of the cylinder identifying system described above, even when the sensor mounting error should occur and/or even when the phase of the cam pulse signal is advanced due to the variable valve timing control, the angle of rotation required for the cylinder identification can be decreased, whereby the engine operation controllability can be enhanced.

In a still further preferred mode for carrying out the invention, the crank angle pulse signal may be comprised of pulse trains each containing a pulse indicative of a reference position for each of the individual cylinders, wherein the plural subperiods are established by dividing the ignition control period with reference to the reference position.

Owing to the feature described above, the angle of rotation required for the cylinder identification can be decreased, whereby the engine operation controllability can be enhanced.

In another preferred mode for carrying out the invention, the cylinder identifying means may be so arranged as to identify the individual cylinders at least either during a predetermined time period from a time point at which the engine operation is started or at a time point corresponding to the most retarded valve drive timing set by the variable valve timing means.

By virtue of the arrangement described above, even when the amount of the stored information series data is small, the angle of rotation required for the cylinder identification can be decreased, whereby the engine operation controllability can be enhanced.

In yet another preferred mode for carrying out the invention, the cylinder identifying system for the internal combustion may further include a phase detecting means for detecting a change of the valve drive timing phase shifted by means of the variable valve timing means on the basis of given specific pulses contained in the cam pulse signal and crank angle position information derived from the crank angle pulse signal.

With the arrangement described above, the angle of rotation required for the cylinder identification can be decreased, whereby the engine operation controllability can be enhanced. Furthermore, high freedom in design as well as cost reduction can be realized.

In still another preferred mode for carrying out the invention which is applied to a four-cylinder internal combustion engine in which the ignition control period for each of the cylinders may be so set as to correspond to a crank angle of 180°, the plural subperiods corresponding to each of the individual cylinders should be comprised of a first subperiod and a second subperiod, respectively, wherein the numbers of the specific pulses contained in the cam pulse signal generated during the first subperiod and the second subperiod, respectively, should be "1" and "0"; "2" and "1"; "0" and "2"; and "0" and "1", respectively, in the sequential order in which the cylinders are controlled.

With the arrangement described above, the angle of rotation required for cylinder identification of the four-cylinder engine can be decreased, whereby engine operation controllability can be enhance.

In a further preferred mode for carrying out the invention applied to a six-cylinder internal combustion engine in which the ignition control period for each of the cylinders is so set as to correspond to a crank angle of 120°, the plural subperiods corresponding to the individual cylinders should be comprised of a first subperiod and a second subperiod, respectively, wherein the numbers of the specific pulses contained in the cam pulse signal generated during the first subperiod and the second subperiod, respectively, should be "1" and "0"; "2" and "0"; "1" and "2"; "0" and "2"; "1" and "1"; and "0" and "1", respectively, in the sequential order in which the cylinders are controlled.

Owing to the arrangement described above, the angle of rotation required for cylinder identification of the six-cylinder engine can be decreased, whereby engine operation controllability can be enhance.

In a yet further preferred mode for carrying out the invention applied to a three-cylinder internal combustion engine in which the ignition control period for each of the cylinders is so set as to correspond to a crank angle of 240°, the plural subperiods should be comprised of a first subperiod, a second subperiod, a third subperiod and a fourth subperiod, respectively, wherein the numbers of the specific pulses contained in the cam pulse signal during the first, second, third and fourth subperiods, respectively, should be "1", "0", "2" and "0"; "1", "2", "0" and "2"; "1", "1", "0" and "1", respectively, in the sequential order in which the individual cylinders are controlled.

With the arrangement described above, the angle of rotation required for cylinder identification of the three-cylinder engine can be decreased, whereby engine operation controllability can be enhance.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 3 is a view for illustrating a cylinder identification table based on subperiods (a) and (b) which is referenced in conjunction with a signal detection pattern;

FIG. 4 is a view showing a cylinder identification table based on subperiods (b) and (a) to be referenced in conjunction with the signal detection pattern illustrated in FIG. 2;

FIG. 6 is a view showing a cylinder identification table based on cam signal pulse trains and detected signal patterns shown in FIG. 5;

FIG. 14 is a view showing a cylinder identification table based on cam signal pulse trains S_cam(n−1) and S_cam (n) according to the first embodiment of the invention;

FIG. 15 is a view showing a table for illustrating cam signal pulse trains S_cam(n−3), S_cam(n−2), S_cam(n−1) and S_cam(n) learned by reference to FIG. 14;

FIG. 18 is a view showing a cylinder identification table based on the pulse signal pattern illustrated in FIG. 17;

FIG. 19 is a view showing a cylinder identification table based on cam signal pulse trains S_cam(n−3), S_cam(n−2), S_cam(n−1) and S_cam(n) learned by referencing the table shown in FIG. 18;

FIG. 22 is a view for illustrating a cylinder identification table based on subperiods (a) and (b) which is referenced in conjunction with the signal detection pattern illustrated in FIG. 21;

FIG. 23 is a view for illustrating cam signal pulse trains S_cam(n−1) and S_cam(n) detected at the time point at which the valve drive timing phase is most retarded in the pulse signal patterns shown in FIG. 21;

FIG. 24 is a view showing a cylinder identification table based on the cam signal pulse trains S_cam(n−3), S_cam (n−2), S_cam(n−1) and S_cam(n) learned on the basis of the result of detection shown in FIG. 23;

FIG. 26 is a view for illustrating a cylinder identification table based on subperiods (a) and (b) which is referenced in conjunction with the signal detection pattern shown in FIG. 25;

FIG. 27 is a view for illustrating cam signal pulse trains S_cam(n−1) and S_cam(n) detected when the valve drive timing phase is most retarded in the pulse signal patterns shown in FIG. 25; and FIG. 28 is a view showing a cylinder identification table based on the cam signal pulse trains S_cam(n−3), S_cam (n−2), S_cam(n−1) and S_cam(n) learned from the result of detection shown in FIG. 27.

DESCRIPTION OF THE PREFERRED EMBODIMENTS

Figure 1:
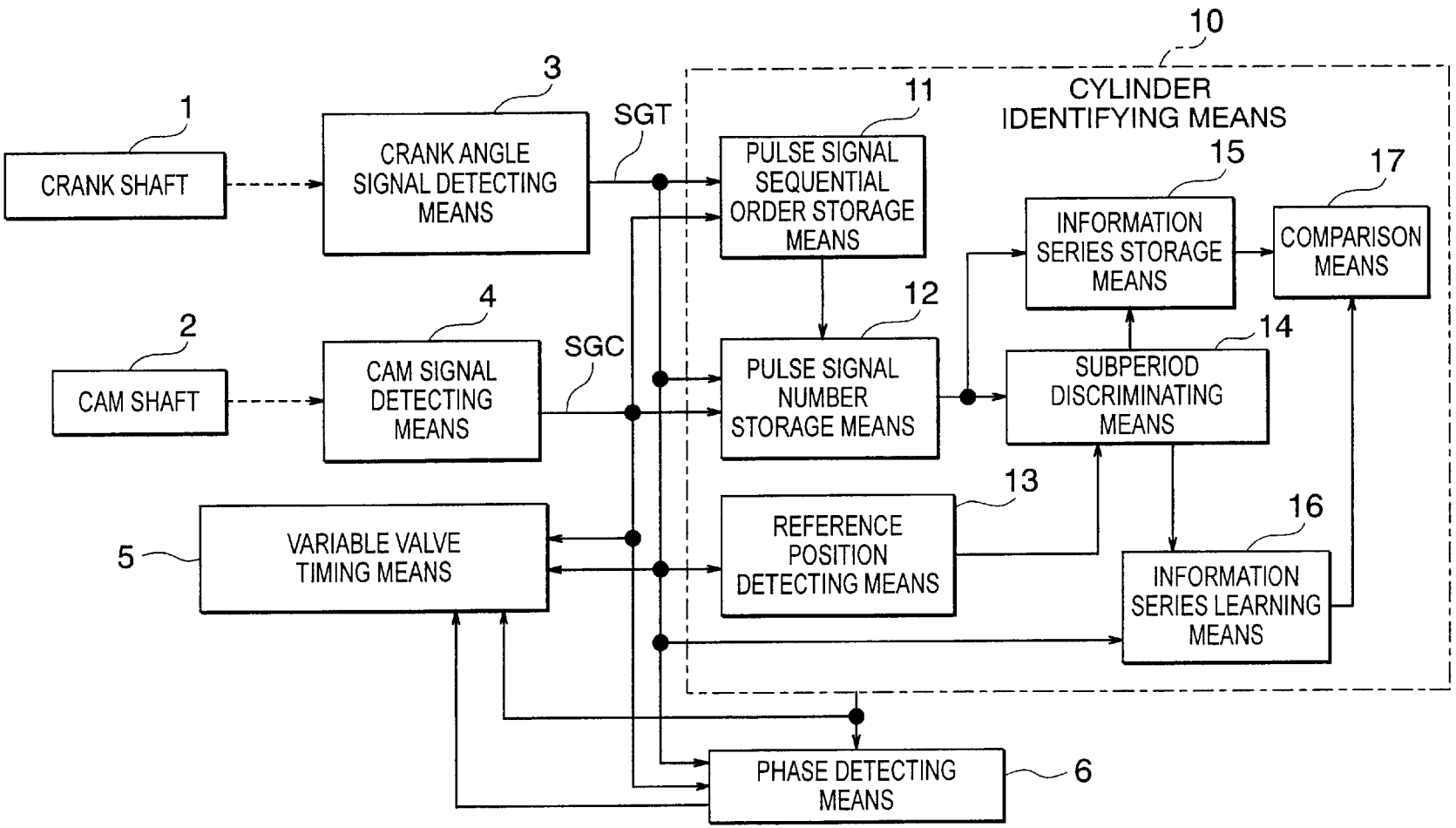
FIG. 1 is a functional block diagram showing generally and schematically a cylinder identifying system for an internal combustion engine according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

Now, description will be made of the cylinder identifying system for an internal combustion engine according to a first embodiment of the present invention by reference to FIG. 1 which schematically shows in a functional block diagram a general configuration of the cylinder identifying system. Referring to the figure, the internal combustion engine (hereinafter also referred to simply as the engine) includes a crank shaft 1 and a cam shaft 2 which rotates at a speed equal to one half of that of the crank shaft 1.

A crank angle signal generating means 3 is provided in association with the crank shaft 1 for thereby generating synchronously with the rotation of the crank shaft 1 a crank angle pulse signal SGT in the form of pulse trains each containing a pulse indicative of a reference position. Further, a cam signal generating means 4 is provided in association with the cam shaft 2 for generating synchronously with rotation of the cam shaft 2 a cam pulse signal SGC which includes particular or specific pulses for identifying the individual cylinders of the engine, respectively.

A variable valve timing means 5 is designed to shift or set variably the phase of the valve drive timing for each cylinder by taking into account the operating state of the engine. In that case, magnitude or quantity of the phase shift is straightforwardly reflected in the cam pulse signal SGC.

At this juncture, definition will be made of the phrase "variable valve timing control (VVT control in short)". With this phrase it is contemplated to mean a control for advancing the timing for opening e.g. a suction valve of the engine cylinder with a view to improving the quality of exhaust gas and the fuel-cost performance of the engine. Parenthetically, such variable valve timing (VVT) control itself is known in the art.

A phase detecting means 6 is designed to detect the change of the valve drive timing phase (e.g. the shift of the suction valve opening timing) effectuated by the variable valve timing means 5 on the basis of the result of the cylinder identification processing executed by a cylinder identifying means 10 which will be described below in detail, given specific pulses contained in the cam pulse signal SGC and crank angle position information arithmetically derived from the crank angle pulse signal SGT. The signal indicative of the detected change of the valve drive timing phase is then fed back to the variable valve timing means 5.

The above-mentioned cylinder identifying means 10 which can be implemented by using an electronic control unit is so arranged as to operate in synchronism with the phase of the valve drive timing (e.g. suction valve opening timing) for each cylinder which is changed by the variable valve timing means 5 for thereby identifying the individual cylinders, respectively, of the engine and at the same time determining discriminatively the reference positions for the individual cylinders, respectively, on the basis of the crank angle pulse signal SGT and the cam pulse signal SGC.

More specifically, the cylinder identifying means 10 is comprised of a pulse signal sequence storage means 11 for storing the pulse sequential order and a pulse signal number storage means 12 for storing the numbers of pulses contained in the crank angle pulse signal SGT and the cam pulse signal SGC, respectively, a reference position detecting means 13 for fetching the crank angle pulse signal SGT outputted from the crank angle signal generating means 3 to thereby detect the reference position mentioned above, a subperiod discriminating means 14 for fetching the output signals of the pulse signal number storage means 12 and the reference position detecting means 13, respectively, an information series storage means 15 and an information series learning means 16 provided in association with the subperiod discriminating means 14, and a comparison means 17.

The pulse signal sequence storage means 11 is so designed as to store therein the temporal relation between the pulse trains each including pulses generated every 10° in terms of the crank angle (i.e., every 10° CA) which are contained in the crank angle pulse signal SGT and the specific pulses for the cylinder identification, which pulse are contained in the cam pulse signal SGC.

On the other hand, the pulse signal number storage means 12 is comprised of a crank angle signal storage means for storing the number of the pulses of the crank angle pulse signal SGT which are detected since the start of the engine operation and a cam pulse signal storage means for storing the number of signal pulses of the cam pulse signal (i.e., signal generated by the sensor provided in association with the cam shaft) SGC generated since the start of the engine operation, wherein the number of the pulses of the crank angle pulse signal SGT and that of the pulses of the cam pulse signal (valve drive timing signal) SGC, respectively, are counted for storage, starting from the time point at which the engine operation is started.

Further, the pulse signal number storage means 12 is so designed as to count for storage the pulse number of the specific pulses generated over the plurality of subperiods which are defined by dividing the ignition control period for each of the individual cylinder in a plurality or a predetermined number of the subperiods with reference to a reference position which will be described below. Incidentally, in the case of the system now under consideration, it is presumed, only by way of example, that the ignition control period is divided into two subperiods (a) and (b), as will hereinafter be made clear.

The reference position detecting means 13 is designed to detect the reference position on the basis of the crank angle pulse signal SGT, while the subperiod discriminating means 14 is designed to discriminate the plural subperiods from each other on the basis of combinations of the numbers of the signal pulses generated during the plural subperiods, respectively.

The information series storage means 15 is designed to store the information series composed of combination of the signal pulse numbers detected currently during the plural subperiods, respectively, while the information series learning means 16 is designed to learn a first information series at a predetermined crank angle based on the crank angle pulse signal SGT.

Further, the information series storage means 15 is so arranged as to store a plurality of information series which can change within a range in which the phase of the valve drive timing is changed by means of the variable valve timing means 5. In that case, the cylinder identifying means 10 is so designed as to identify a particular or given cylinder on the basis of at least one of the plural information series (e.g. either one of the first and second information series described below). The information series may be composed of e.g. four successive signals, which will be described later on.

The information series learning means 16 is designed to learn the first information series at least at one of the most retarded valve drive timing and the most advanced valve drive timing set by means of the variable valve timing means 5. Further, the information series learning means 16 is adapted to learn the first information series upon starting of operation of the engine.

The comparison means 17 is designed to compare the information series detected currently with the first information series as learned, to thereby output the result of comparison. The cylinder identification is to be performed on the basis of the result of this comparison.

The cylinder identifying means 10 is designed to discriminatively determine or identify the individual cylinders on the basis of the result of comparison performed by the comparison means 17 as well as the information series stored in the information series storage means 15.

The cylinder identifying means 10 may include a changeable information series arithmetic means (not shown) for determining arithmetically a second information series which is changeable within a range of a predetermined crank angle on the basis of the first information series and the range within which the change of the valve drive timing phase can be effectuated by the variable valve timing means 5.

In that case, the cylinder identifying means 10 identifies the individual cylinders on the basis of the result of comparison between the information series detected currently and at least one of the first and second information series.

It should also be added that the cylinder identifying means 10 identifies the individual cylinders within a predetermined time period starting from the time point at which the engine operation is started or alternatively at the most retarded valve drive timing set by means of the variable valve timing means 5.

Figure 2:
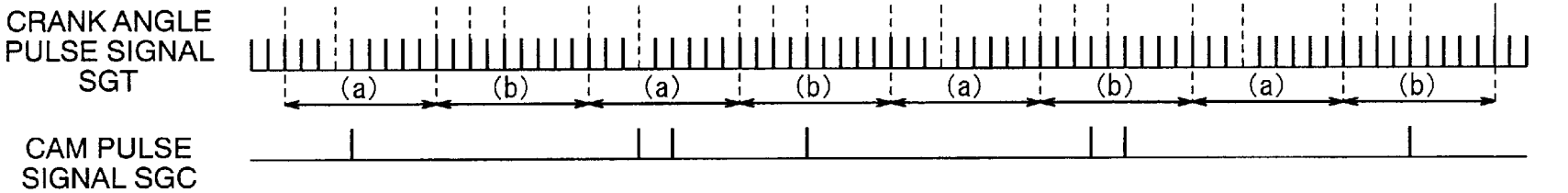
FIG. 2 is a timing chart showing signal patterns of a crank angle pulse signal and a cam pulse signal, respectively, in a four-cylinder internal combustion engine according to the first embodiment of the present invention.

FIG. 2 is a timing chart showing signal patterns of the crank angle pulse signal SGT and the cam pulse signal SGC, respectively, generated in the cylinder identifying system according to the instant embodiment of the invention on the presumption that the internal combustion engine of concern includes, for example, four cylinders.

Referring to FIG. 2, the crank angle pulse signal SGT includes a pulse dropout at the reference position A25° CA (i.e., position succeeding to the top dead center (TDC) by 25° in terms of the crank angle, hereinafter also denoted simply by "position A25") for each of the engine cylinders #1 to #4.

On the other hand, the cam pulse signal SGC is shown in a pulse generation pattern on the presumption that the phase of the variable valve timing remains unchanged (the valve drive timing is most retarded).

Parenthetically, in FIG. 2, the crank angle positions are shown for each cylinder over a range extending from a position B95° CA (i.e., position preceding to the top dead center by 95° in terms of the crank angle or CA, hereinafter denoted simply by "position B95") approximately to the position A25 around the center of approximately B05° CA (i.e., position preceding to the top dead center by 5° in terms of CA, hereinafter denoted simply by "position B05").

In more concrete, the crank angle pulse signal SGT is composed of pulse trains containing pulses generated at every predetermined crank angle (every 10° CA), wherein the reference position A25 at which the reference signal makes appearance every 180° CA corresponds to the position of a ring gear where one tooth is dropped or absent, the ring gear constituting a part of the crank angle sensor, as is known in the art. Accordingly, the reference position detected actually in response to the tooth dropout corresponds to the position succeeding to the top dead center (TDC) by 35° in terms of the crank angle (hereinafter referred to as "position A35").

As can be seen in FIG. 2, in the case of the four-cylinder internal combustion engine, the ignition control period corresponds to 180° CA, wherein the TDC period (top dead center period) of each cylinder which extends over the angular range of 180° CA of the crank angle pulse signal SGT is divided into a subperiod (a) which ranges from B05° CA to B95° CA and which contains the reference position A35 (i.e., A35° CA) (corresponding to the tooth dropout position) and a subperiod (b) which ranges from B95° CA to B05° CA which does not include the reference position A35 (A35° CA).

On the other hand, the cam pulse signal SGC includes different numbers of the specific signal pulses (combinations of "0"; "1" and "2") in correspondence to the individual different cylinders, respectively.

In that case, the numbers of the specific pulses contained in the cam pulse signal SGC generated during the subperiods (a) and (b), respectively, are so set for the individual cylinders as to be "1" and "0"; "2" and "1"; "0" and "2"; and "0" and "1", respectively, in the sequential order in which the cylinders are controlled.

More specifically, on the presumption that the ignition control period (TDC period 180° CA of the crank angle pulse signal SGT) for each of the cylinders is divided into a plurality of subperiods (two subperiods in the illustrated case), the cam pulse signal SGC is so set that the combinations of the numbers ("0" to "2") of the specific signal pulses generated during the subperiods (a) and (b), respectively, differ in correspondence to the plural subperiods (subperiods (a) and (b)), respectively, independent of the time point at which the operation of the pulse signal number storage means 12 is started.

By virtue of the arrangement described above, the cylinder identifying means 10 is capable of identifying or discerning discriminatively the individual cylinders of the engine on the basis of the result of determination of the subperiod discriminating means 14 independently of the positional relationships between the storage starting point of the pulse signal number storage means 12 and the plural subperiods (a) and (b).

FIGS. 3 and 4 are views showing tables for illustrating correspondences between the pulse numbers in the subperiods (a) and (b) and the corresponding cylinders identified. More specifically, FIG. 3 shows the cylinders identified by the series of the pulse numbers during the subperiods (a) and (b) in this order, while FIG. 4 shows the cylinders identified by the series of the pulse numbers during the subperiods (b) and (a) in this order.

As can be seen from FIGS. 3 and 4, the individual cylinders can definitely be identified by two pulse series (i.e., two pulse trains) of the cam pulse signal SGC during two successive subperiods independently of the sequential order of these detection subperiods (a) and (b).

To say in another way, by making use of both the crank angle pulse signal SGT and the cam pulse signal SGC illustrated in FIG. 2, the crank rotation angle equivalent to the time taken for completing the cylinder identification is 180° CA at minimum and 270° CA at maximum. By contrast, in the case of the conventional cylinder identifying system, the corresponding maximum crank rotation angle is 360° CA. It can thus be understood that in the cylinder identifying system according to the instant embodiment of the invention, the time taken for the cylinder identification can be shortened when compared with the conventional system.

Figure 5:
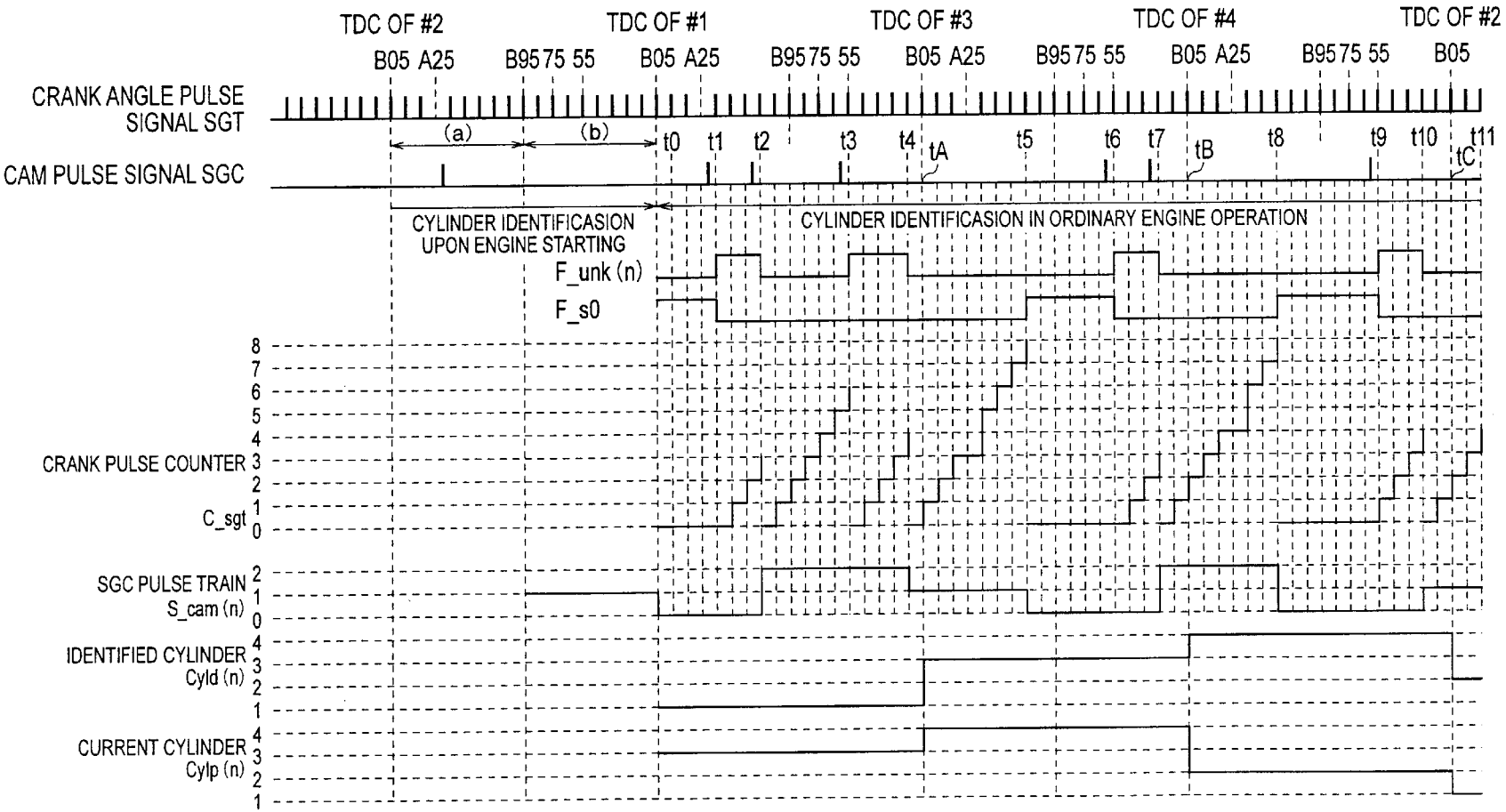
FIG. 5 is a timing chart for illustrating cylinder identifying operation carried out in the cylinder identifying system according to the first embodiment of the present invention.

FIG. 5 is a timing chart for illustrating the cylinder identifying operations in the engine operation starting mode and the ordinary engine operation mode. More specifically, this figure illustrates relationships between the crank angle pulse signal SGT, the cam pulse signal SGC, values of various flags and various counters on one hand and the identified cylinders on the other hand in the case of a four-cylinder internal combustion engine.

Referring to FIG. 5, in the ordinary engine operation mode, the variable valve timing (VVT) is most retarded (i.e., change of the valve drive timing phase=0).

An unknown flag F_unk(n) is used for detecting the pulse number (pulse train) of the cam pulse signal SGC. This flag F_unk(n) is set to "ON" in the case where it is unknown whether the cam signal pulse number is "1" or "2".

A zero flag F_s0 is used for detecting the number of pulses of the cam pulse signal SGC. This flag is set to "ON" when this pulse number is "0" in the preceding cycle (i.e., when the number of pulses of the preceding cam pulse signal is zero).

A crank pulse counter C_sgt is employed for measuring the number of pulses of the crank angle pulse signal SGT generated between a given pulse and the succeeding one of the cam pulse signal in order to detect the number of the pulses of the cam pulse signal SGC. The counter is incremented every time the pulse of the crank angle pulse signal SGT is detected.

In more concrete, the crank pulse counter C_sgt is incremented by "1" at every crank angle of 10° CA while it is incremented by "2" only when the crank angle pulse A35 is detected immediately after the crank angle reference signal pulse (indicative of the dropout tooth position).

A cam signal pulse train S_cam(n) indicates the latest number of the cam signal pulses ("0", "1" or "2") observed at the current time point.

The identified cylinder Cyld(n) represents the cylinder identified on the basis of the current cam signal pulse S_cam(n). On the other hand, the current cylinder Cylp(n) represents the cylinder which is to undergo the control succeedingly and which can be identified on the basis of currently identified cylinder cyld(n).

FIG. 6 is a view showing a table for illustrating correspondences between combinations of the cam signal pulse trains (i.e., pulse trains of the cam pulse signal SGC) S_cam(n) and the identified cylinders. Parenthetically, the combination of the cam signal pulse trains will also be referred to as the information series.

In the following, the cylinder identifying operation of the cylinder identifying system according to the instant embodiment of the invention will be described sequentially in the time-based order by referring to FIGS. 5 and 6.

At first, in the engine starting operation mode, the cylinder identification is performed on the basis of the numbers of pulses of the cam pulse signal SGC generated during the subperiods (a) and (b), respectively, by referencing the table illustrated in FIG. 3.

In the engine starting operation mode, the number of pulses generated during the subperiod (a) is "1" while it is "0" in the subperiod (b). Accordingly, the cylinder Cyld(n) identified at the time point to (B05 CA) is the cylinder #1, while the cylinder Cylp(n) which is to undergo the identification succeedingly is the cylinder #3, as can be seen in FIG. 3.

Further, the instantaneous value of the cam signal pulse train S_cam(n) is "1" at the end point (B95) of the subperiod (a) before the top dead center of the cylinder #1 while it is "0" at the end point (B05) of the subperiod (b) which precedes to the top dead center of the cylinder #1, as can be seen in FIG. 5.

At this juncture, it should be mentioned that the cylinder identifying means 10 is so designed as to identify the cylinder on the basis of combination of the numbers of the pulses of the cam pulse signal SGC generated during the subperiods (a) and (b) (see FIG. 3) until the cylinder #1 reaches the position B05 (time point t0), whereas in the succeeding ordinary operation mode, the cylinder identification is performed on the basis of the cam signal pulse train S_cam(n).

As is apparent from FIG. 5, at the position B05 (i.e., at the time point t0) of the cylinder #1, the unknown flag F_unk(n) is "0", the zero flag F_s0 is "1" and the crank pulse counter C_sgt is "0".

In succession, in the period during which the state of the zero flag F_s0 remaining "1" continues, the crank pulse counter C_sgt remains in the state "0" without being counted up or incremented.

Upon every detection of the crank angle pulse signal SGT, it is checked whether or not the cam pulse signal SGC has been detected during the time period lapsed from the preceding detection of the crank angle pulse signal SGT to the current detection thereof.

By way of example, at the time point t1 (i.e., the time point at which the reference position A35 is detected), one pulse of the cam pulse signal SGC is detected, which has been generated during the period extending from the preceding time point at which the pulse of the crank angle signal SGT was detected (i.e., position A15° CA) to the current time point of detection of the pulse of the crank angle signal SGT (i.e., position A35° CA).

At this time point, it is still unknown whether the detected pulse of the cam pulse signal SGC is the first pulse of the two-pulse train appearing during one subperiod or the very one pulse constituting the single-pulse train itself. Accordingly, the unknown flag F_unk(n) is set to "ON".

Further, at the time point t1, the crank pulse counter C_sgt is cleared to "0", whereon the crank pulse counter C_sgt is succeedingly counted up or incremented every time the crank angle pulse signal SGT is detected.

Thereafter, taking into account the fact that the inter-pulse distance of the two-pulse train (i.e., pulse train including two pulses) is preset to a predetermined angular value (e.g. 3), it can be decided that the concerned pulse train of the cam pulse signal SGC is the single-pulse train (i.e., pulse train composed of one pulse) unless the succeeding pulse of the cam pulse signal SGC is detected at the time point when the crank pulse counter C_sgt becomes equal to "4" in the state where the unknown flag F_unk(n) is "1".

On the contrary, when the succeeding pulse of the cam pulse signal SGC is detected in the state where the count value of the crank pulse counter C_sgt is equal to or smaller than "4", it can then be decided that the concerned pulse train of the cam pulse signal is the two-pulse train (i.e., pulse train composed of two pulses).

In the case of the example illustrated in FIG. 5, a pulse of the cam pulse signal SGC has been detected during the period extending from the time point at which the preceding pulse of the crank angle signal SGT was detected (i.e., position B125° CA) to the time point at which the pulse of the crank angle signal is currently detected (i.e., position B115° CA) when the pulse of the crank angle signal SGT is detected at the position B115° CA temporally succeeding to the time point t2. Thus, it can be decided that the detected pulse of the cam pulse signal SGC is that of the two-pulse train.

Thus, the current pulse train S_cam(n) of the cam pulse signal SGC is set to "2".

On the other hand, the crank pulse counter C_sgt is cleared to "0" to be subsequently incremented every time the pulse of the crank angle pulse signal SGT is detected.

When the succeeding pulse train of the cam pulse signal SGC is "0" (i.e., when the succeeding pulse train of the cam pulse signal SGC contains no pulse) after the pulse train S_cam(n) of "2" (two-pulse train) has been determined, this then means that no pulses of the cam pulse signal SGC can be detected during the predetermined period.

Accordingly, in the case where no pulse of the cam pulse signal SGC is detected on the basis of the preset inter-pulse angular distance value at the time point at which the crank pulse counter C_sgt becomes equal to "8", it is then decided that the relevant pulse train of the cam pulse signal SGC is "0".

On the contrary, when the pulse of the cam pulse signal SGC is detected at the time point at which the crank pulse counter C_sgt becomes equal to or smaller than "8" after determination of the pulse train S_cam(n), it is decided that the pulse concerned is the first or leading pulse of the two-pulse train or the very pulse of the single-pulse train.

Referring to FIG. 5, at the time point t3 (i.e., at the position B55° CA of the cylinder #3), the unknown flag F_unk(n) is set to "ON" with the crank pulse counter C_sgt being cleared to zero, because the pulse of the unknown pulse train of the cam pulse signal SGC has been detected in the state where the count value of the crank pulse counter C_sgt is "6".

Similarly, at the time point t4 (corresponding to the position B15° CA of the cylinder #3), the pulse train S_cam(n) of the cam pulse signal SGC is set to "1" (i.e., determined to be the single-pulse train) with the crank pulse counter C_sgt being cleared to "0", because no pulse of the cam pulse signal SGC has been detected up to the time point when the crank pulse counter C_sgt is incremented to "4" in the state where the unknown flag F_unk(n) is set to "1".

Subsequently, at the time point tA (position B05), the cylinder identification is executed. At this time point, four pulse trains S_cam(n−3), S_cam(n−2), S_cam(n−1) and S_cam(n) of the cam pulse signal SGC which represent in combination the information series are "1" (single-pulse train), "0" (zero-pulse train), "2" (two-pulse train) and "1" (single-pulse train), respectively, it can be determined by referencing the table shown in FIG. 6 that the cylinder Cyld(n) identified currently is the cylinder #3 and that the cylinder Cylp(n) to be identified next is currently the cylinder #4.

Next, at the time point t5 shown in FIG. 5, the unknown flag F_unk(n) is "0", and no pulse of the cam pulse signal SGC is detected until the crank pulse counter C_sgt is incremented up to "8". Consequently, the pulse train S_cam (n) of the cam pulse signal SGC is set to "0" and at the same time the zero flag F_s0 is set to "1".

Subsequently, during the time period from the time point t5 to the time point t6, the zero flag F_s0 remains being set to "1". Consequently, the crank pulse counter C_sgt is not incremented. Incidentally, zero-pulses are not arrayed in succession in the cam pulse signal SGC. This means that the pulse train succeeding to the zero-pulse train is necessarily the single-pulse train or the two-pulse train.

Next, at the time point t6, the leading pulse of the two-pulse train or thereby one pulse constituting the single-pulse train is detected. Thus, the zero flag F_s0 is cleared whereas the unknown flag F_unk(n) is set.

At the time point t7, the pulse of the cam pulse signal SGC is detected when the crank pulse counter C_sgt is equal to "3". Consequently, the pulse train S_cam(n) of the cam pulse signal SGC is set to "2" with the unknown flag F_unk(n) being cleared.

Subsequently, at the time point tB (time point for the cylinder identification), it is determined that four pulse trains S_cam(n−3), S_cam(n−2), S_cam(n−1) and S_cam(n) of the cam pulse signal SGC are "2" (two-pulse train), "1" (single-pulse train), "0" (zero-pulse train) and "2" (two-pulse train), respectively. Thus, it can be determined on the basis of the table data shown in FIG. 6 that the cylinder Cyld(n) currently concerned is the cylinder #4 and that the cylinder Cylp(n) to be identified next is currently the cylinder #2.

Similarly, at the time points t8 to t11 and the time point tC for the cylinder identification, processings similar to those described above are executed repetitively, whereby four pulse trains S_cam(n−3), S_cam(n−2), S_cam(n−1) and S_cam(n) of the cam pulse signal SGC are determined to be "0" (zero-pulse train), "2" (two-pulse train), "0" (zero-pulse train) and "1" (single-pulse train), respectively. Thus, it can be determined by referencing the table data shown in FIG. 6 that the cylinder Cyld(n) currently concerned is the cylinder #12 and that the cylinder Cylp(n) to be next identified is currently the cylinder #1.

Incidentally, the signal patterns shown in FIG. 5 are depicted on the presumption that no change of the valve drive timing phase occurs due to the variable valve timing control. It should however be understood that the cylinder identification can be carried out similarly even in the case where the change of the valve drive timing phase takes place due to the variable valve timing control in the ordinary operation mode.

Figure 7:
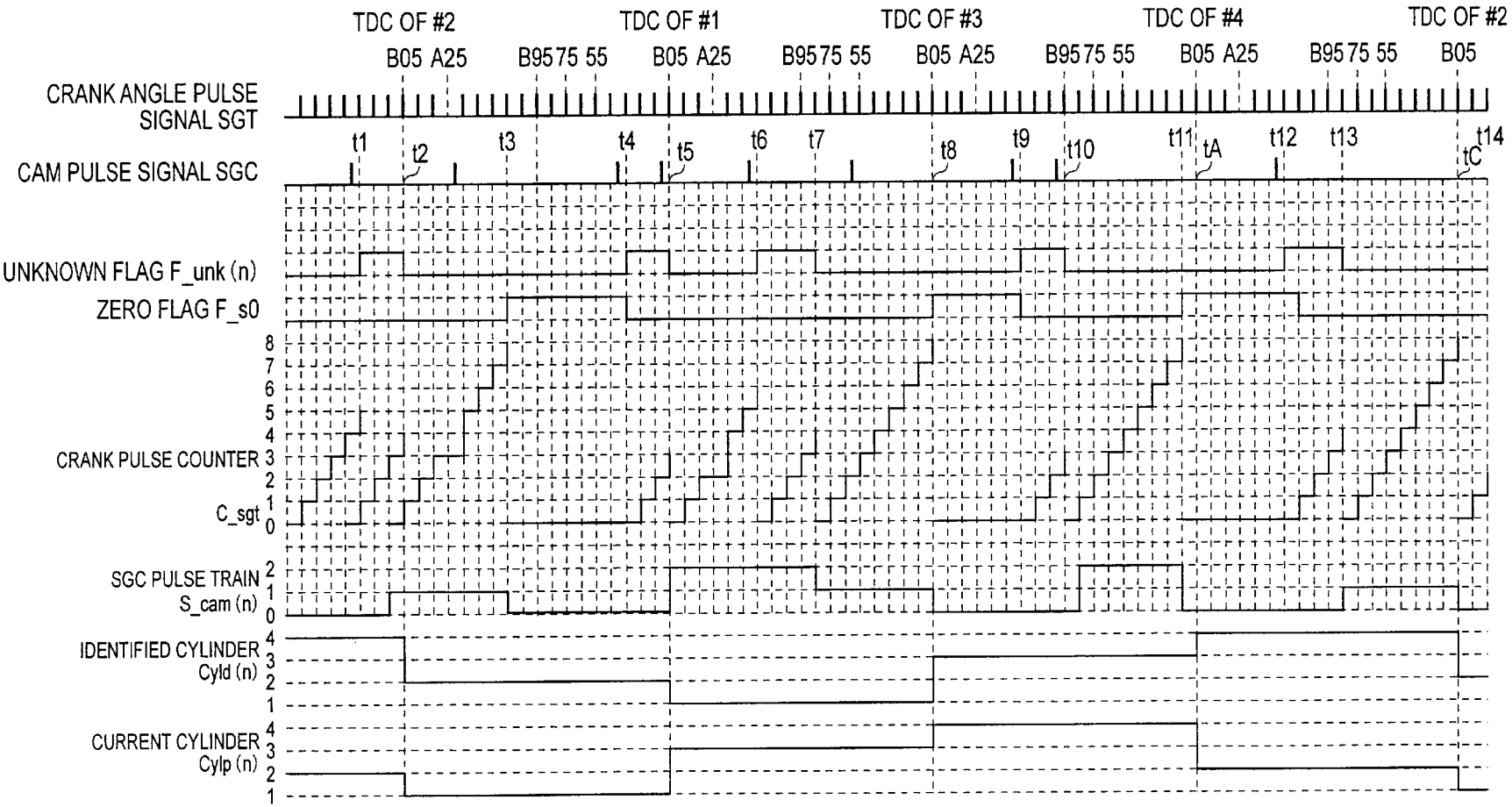
FIG. 7 is a timing chart for illustrating a cylinder identifying operation carried out in the cylinder identifying system during operation of a variable valve timing system according to the first embodiment of the present invention.

FIG. 7 is a timing chart for illustrating the cylinder identifying operation in the case where change takes place in the valve drive timing phase due to the variable valve timing control. In the figure, the processing operations performed at the time points t1 to t14, respectively, are similar to those described above by reference to FIG. 5. In other words, determination of the pulse trains of the cam pulse signal SGC as well as the cylinder identification can be realized through the procedure described previously.

Next, referring to flow charts shown in FIGS. 8 to 11, description will be made of the processing operations carried out by the cylinder identifying means 10 incorporated in the cylinder identifying system according to the first embodiment of the present invention.

Figure 8:
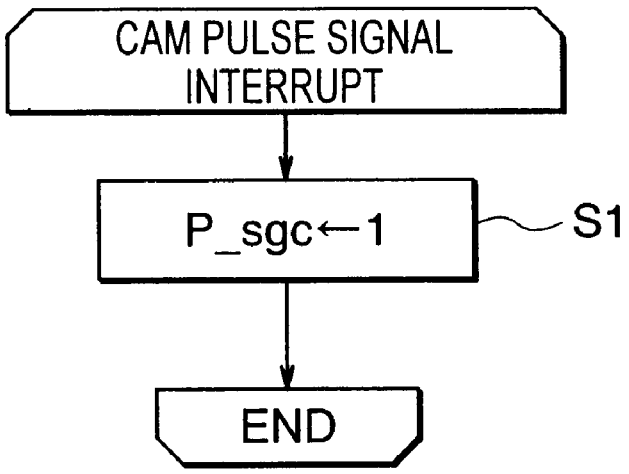
FIG. 8 is a flow chart for illustrating an interrupt processing routine executed by a cylinder identifying means in the cylinder identifying system according to the first embodiment of the present invention.
Figure 9:
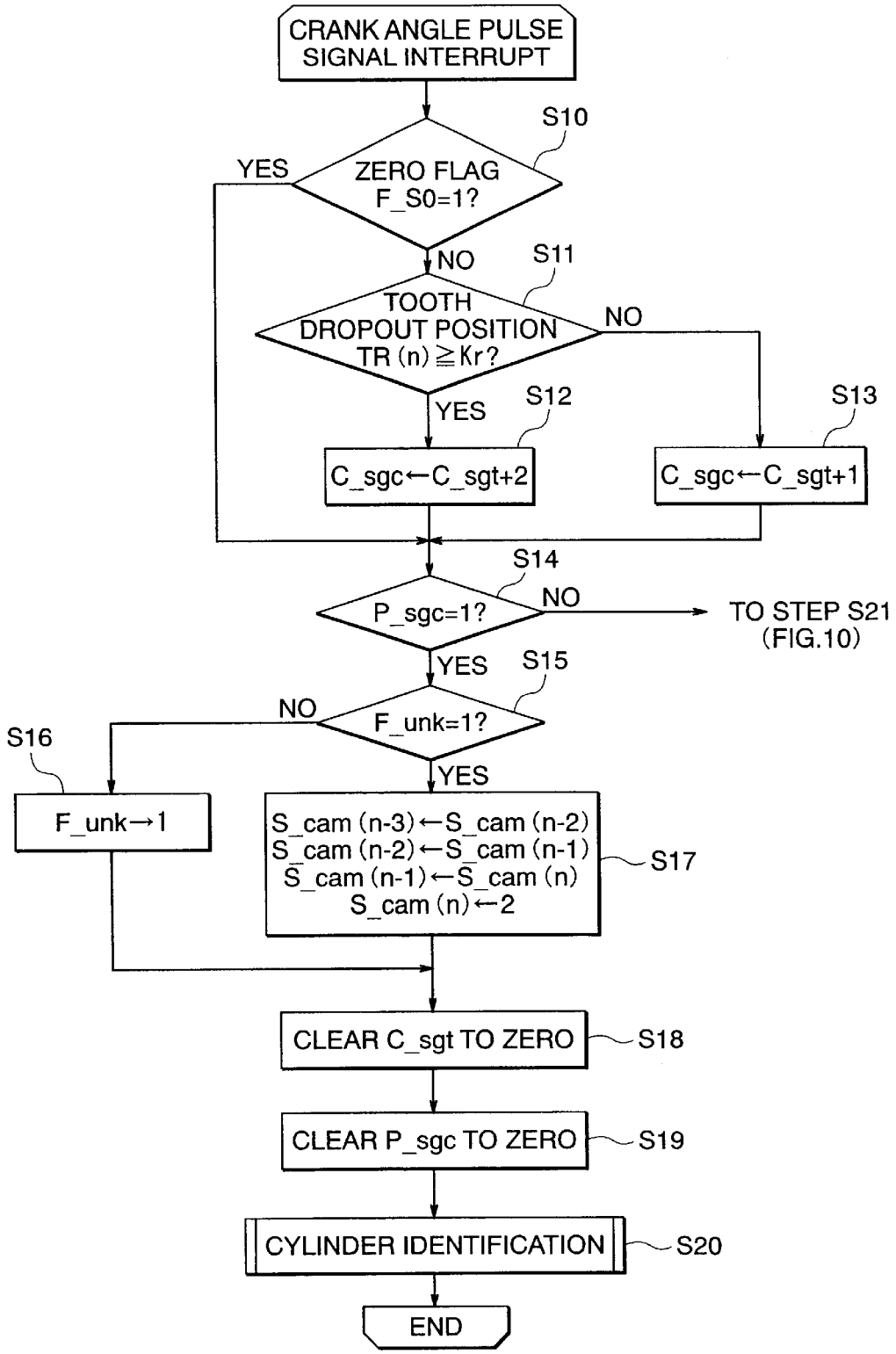
FIG. 9 is a flow chart for illustrating an interrupt processing routine executed by the cylinder identifying means in the cylinder identifying system according to the first embodiment of the present invention.
Figure 10:
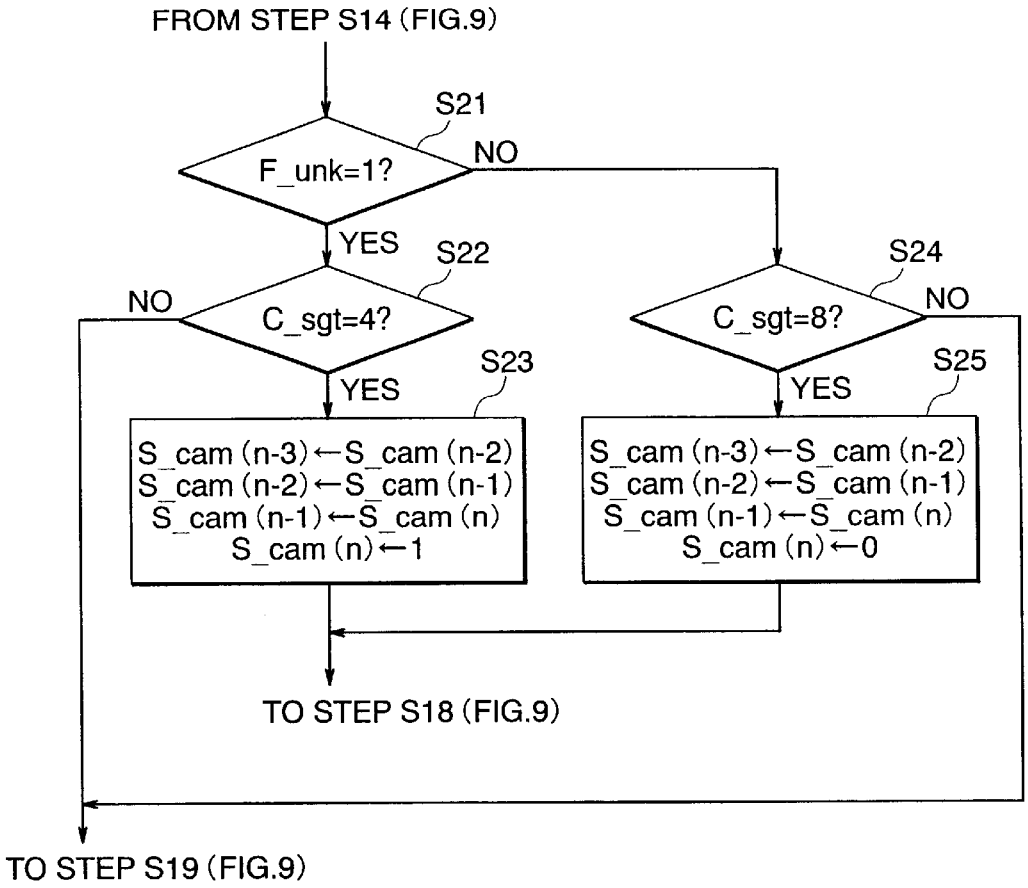
FIG. 10 is a flow chart for illustrating an interrupt processing routine executed by the cylinder identifying means in the cylinder identifying system according to the first embodiment of the present invention.
Figure 11:
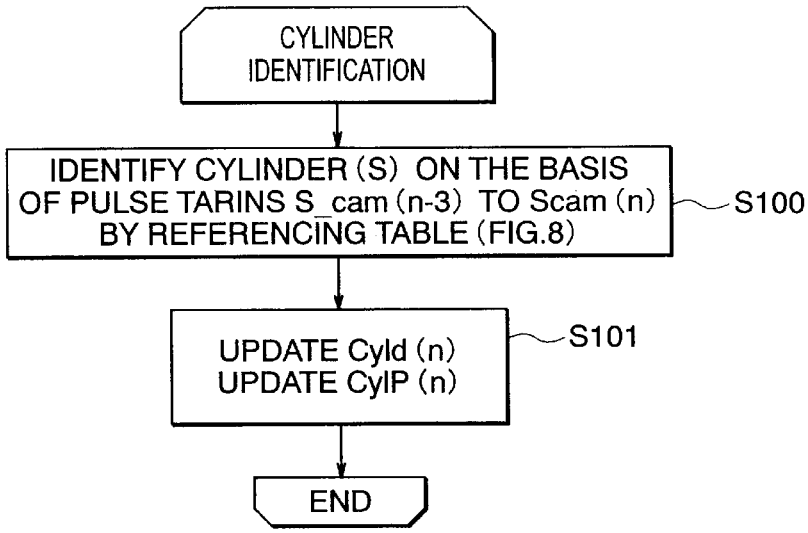
FIG. 11 is a flow chart for illustrating operation of a cylinder identification processing according to the first embodiment of the invention.

FIG. 8 shows an interrupt processing routine (also referred to as the interrupt handling routine) activated in response to the cam pulse signal SGC, FIGS. 9 and 10 show interrupt processing routines, respectively, which are activated in response to the crank angle pulse signal SGT, and FIG. 11 shows a cylinder identification processing routine which constitutes a part of the procedure shown in FIG. 9.

Referring to FIG. 8, reference symbol "P_sgc" denotes a number of pulses of the cam pulse signal SGC detected during a period which intervenes between two pulses of the crank angle pulse signal SGT. On the other hand, reference symbol "TR(n)" shown in FIG. 9 represents the ratio of period of the current crank angle pulse signal SGT to that of the preceding one.

Now referring to FIG. 8, the pulse signal sequence storage means 11 and the pulse signal number storage means 12 incorporated in the cylinder identifying mean 10 respond to generation of a pulse of the cam pulse signal SGC to store the generated pulse number P_sgc (set to "1") of the cam pulse signal SGC in correspondence or combination with the pulse detection period of the crank angle pulse signal SGT (step S1).

On the other hand, referring to FIG. 9, the pulse signal number storage means 12 makes decision as to whether or not the zero flag F_s0 indicating that the preceding cam signal pulse number of "0" (zero) is set (i.e., F_s0="1") in a step S10. When it is decided in the step S10 that F_s0="1" (i.e., when the decision step S10 results in affirmation "YES"), the processing then proceeds to a step S14 described later on.

By contrast, when it is decided in the step S10 that F_s0="0" (i.e., when the decision step S10 results in negation "NO"), it is decided with the aid of the reference position detecting means 13 whether or not the current crank angle position corresponds to the dropout tooth position by making decision as to whether or not the pulse period ratio TR(n) between the preceding and current crank angle pulse signals SGT is equal to or greater than a predetermined value Kr (step S11).

When it is decided in the step S11 that the pulse period ratio TR(n) is equal to or greater than the predetermined value Kr (i.e., when the decision step S11 results in "YES"), the crank pulse counter C_sgt for determining discriminatively the crank angle position is incremented by "2" (step S12). On the contrary, when it is decided in the step S11 that the pulse period ratio TR(n) is smaller than the predetermined value Kr (i.e., when the decision step S11 results in "NO"), the crank pulse counter C_sgt is incremented by "1" (step S13), whereon the processing proceeds to the step S14.

Subsequently, the cylinder identifying means 10 references the data stored in the pulse signal number storage means 12 to make decision as to whether or not the number P_sgc of the generated pulses of the cam pulse signal SGC is "1" (step S14). When it is decided in the step S14 that the generated pulses number P_sgc of the cam pulse signal SGC is not equal to "1" (i.e., when the decision step S14 results in "NO"), the processing then jumps to a step S21 shown in FIG. 10, which step will be described later on.

By contrast, when it is decided in the step S14 that the generated pulse number P_sgc of the cam pulse signal SGC is equal to "1" (i.e., when the decision step S14 results in "YES"), decision is then made in a step S15 as to whether or not the unknown flag F_unk has already been set (i.e., whether F_unk(n)="1").

When it is decided in the step S15 that the unknown flag F_unk is equal to "0" (zero) (i.e., when the decision step S15 results in "NO"), then the unknown flag F_unk is set to "1" in a step S16, whereon the processing proceeds to a step S18 described later on.

Further, when it is decided in the step S15 that the unknown flag F_unk is equal to "1" (i.e., when the decision step S15 results in "YES"), then the four cam signal pulse trains S_cam(n−2), S_cam(n−1), S_cam(n) and "2" (two-pulse train) at the current time point are shifted by one arithmetic operation cycle to thereby allow the preceding pulse trains S_cam(n−3), S_cam(n−2), S_cam(n−1) and S_cam(n) to be resumed in a step S17.

In succession, the crank pulse counter C_sgt is cleared to "0" (zero) in the step S18 with the generated pulse number P_sgc of the cam pulse signal SGC being also cleared to "0" in a step S19, which is then followed by execution of the cylinder identification processing routine shown in FIG. 11 in a step S20, whereupon the crank angle signal interrupt processing shown in FIG. 9 comes to an end.

By contrast, when it is decided in the step S14 that the generated pulse number P_sgc of the cam pulse signal SGC is not equal to "1" (i.e., when the decision step S14 results in "NO"), the processing proceeds to the step S21 shown in FIG. 10.

Referring to FIG. 10, decision is firstly made in the step S21 as to whether the unknown flag F_unk is "1" or not. When it is decided in the step S21 that F_unk(n)="1" (i.e., when the decision step S21 results in "YES"), it is then decided in a step S22 as to whether or not the crank pulse counter C_sgt is "4" in a step S22.

When it is decided in the step S22 that crank pulse counter C_sgt is not equal to "4" (i.e., when the decision step S22 results in "NO"), the processing jumps at once to the step S19 shown in FIG. 9. By contrast, when it is decided in the step S22 that the crank pulse counter C_sgt is equal to "4" (i.e., when the decision step S22 results in "YES"), the four cam signal pulse trains S_cam(n−2), S_cam(n−1), S_cam (n) and "1" (single-pulse train) at the current time point are shifted to the preceding pulse train values S_cam(n−3), S_cam(n−2), S_cam(n−1) and S_cam(n), respectively, in a step S23, whereon the processing proceeds to the step S18 shown in FIG. 9.

On the other hand, when it is decided in the step S21 that the unknown flag F_unk is not equal to "1" or F_unk 1 (i.e., when the decision step S21 results in "NO"), decision is then made as to whether or not the crank pulse counter C_sgt is equal to "8" in a step S24. When it is decided that C_sgt 8 (i.e., when the decision step S24 results in "NO"), the processing immediately proceeds to the step S19 shown in FIG. 9.

Further, when it is decided in the step S24 that the crank pulse counter C_sgt is equal to "8" (i.e., when the decision step S24 results in "YES"), the four cam signal pulse trains S_cam(n−2), S_cam(n−1), S_cam(n) and "0" (zero-pulse train) at the current time point are shifted to the preceding train values S_cam(n−3), S_cam(n−2), S_cam(n−1) and S_cam(n), respectively, in a step S25, whereon the processing proceeds to the step S18 shown in FIG. 9.

Figure 12:
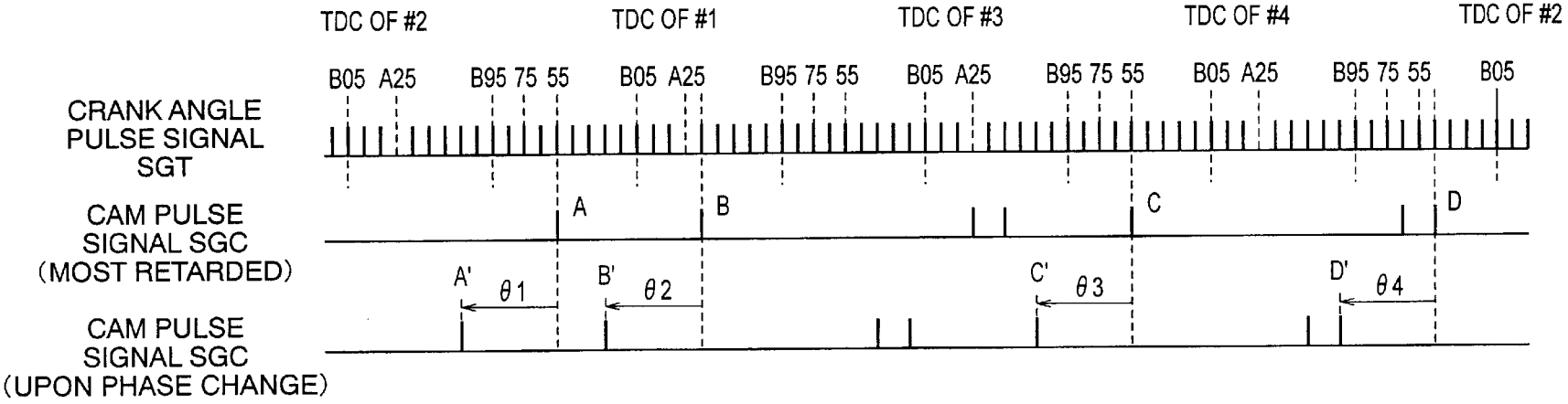
FIG. 12 is a timing chart for illustrating operation of a phase detecting means in the cylinder identifying system according to the first embodiment of the invention.

Next, referring to the timing chart shown in FIG. 12, description will be directed to operation of the phase detecting means 6 which is designed for detecting the phase shift magnitude or quantity of the variable valve timing by making use of the pulse trains of the cam pulse signal SGC.

In FIG. 12, there are illustrated in correspondence to the crank angle pulse signal SGT a pattern of the cam pulse signal SGC when the variable valve timing is in the most retarded phase (i.e., the state where the phase undergoes no change) and a pattern of the same when the phase of the cam pulse signal SGC (valve drive timing) changes.

Referring to FIG. 12, some pulses of the cam pulse signal SGC, i.e., pulses A, B, C and D in the illustrated example, are made use of for the valve drive timing phase detection. The quantities or magnitudes 1, 2, 3 and 4 of the changes of the crank angle position indicated by pulses A', B', C' and D' of the cam pulse signal SGC upon change of the phase of the valve drive timing correspond to the magnitudes or quantities of the phase shift brought about by the variable valve timing (VVT) means 5.

The phase detecting means 6 is designed to ascertain in advance the crank angle positions (i.e., position B55 of the cylinder #1, the position A35 of the cylinder #3, the position B55 of the cylinder #4 and the position B45 of the cylinder #2) upon detection of the pulses A, B, C and D in the state where the cam pulse signal SGC (valve drive timing) is in the most retarded phase.

When the phase of the cam pulse signal SGC changes due to the variable valve timing control, the phase detecting means 6 arithmetically determines differences 1, 2, 3 and 4 between the crank angle positions (i.e., B115 of the cylinder #1, B25 of the cylinder #3, B115 of the cylinder #4 and B105 of the cylinder #2) indicated by the pulses A', B', C' and D' and the crank angle positions indicated by the pulses A, B, C and D, respectively, to thereby detect these differences as the phase change quantities of the cam pulse signal SGC, respectively.

In FIG. 12, there are illustrated the phase change quantities 1, 2, 3 and 4 when the phase of the cam pulse signal SGC is most advanced (by ca. 60° CA) due to the variable valve timing control. The cam pulse signal phase change quantities 1 to 4 as detected are fed back to the variable valve timing means 5 to be used for effectuating properly the variable valve timing control.

In this case, the cylinder identifying means 10 can generate a complicated cam signal pulse pattern which allows the cylinder identification to be effectuated as early as possible, wherein the cylinder identification is realized on the basis of the cam signal pulse number trains described hereinbefore. Accordingly, even when the phase of the cam pulse signal changes due to the variable valve timing control in the internal combustion engine equipped with the variable valve timing means 5 (so-called VVT mechanism), the cylinder identification processing can speedily be completed, which contributes to enhancement and improvement of the starting operation performance of the engine.

Figure 13:
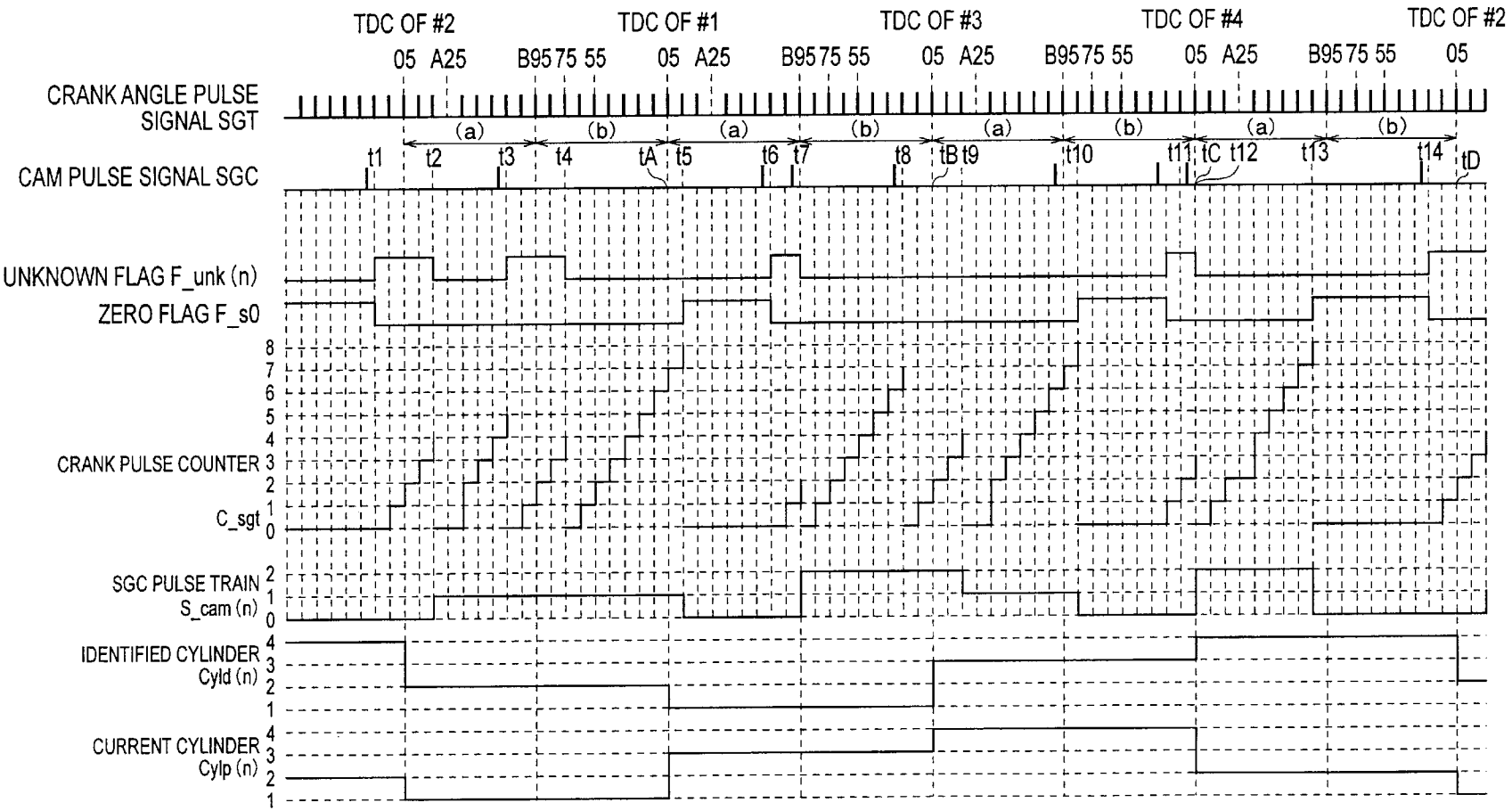
FIG. 13 is a timing chart for illustrating a cylinder identification operation with the aid of an information series learning means in the cylinder identifying system according to the first embodiment of the invention.

Next, by referring to FIG. 13, description will turn to the cylinder identifying operation carried out with the aid of the information series learning means 16.

FIG. 13 shows pulse patterns in the state in which the phase of the cam pulse signal is most retarded due to the variable valve timing control and illustrates the cylinder identification processing in which learned pulse trains (i.e., pulse trains in which mounting error of the cam signal sensor is taken into account) based on the pulse trains of the crank angle pulse signal SGT (crank angle position) and the cam pulse signal SGC.

The information series learning means 16 is designed to learn the pulse trains of the cam pulse signal SGC in the state in which the phase of the cam pulse signal is most retarded (without being advanced at all) due to the variable valve timing control. Because the phase of the cam pulse signal SGC is most retarded, numbers of pulses of the crank angle pulse signal SGT described hereinbefore by reference to the tables shown in FIGS. 3 and 4 make appearance in the subperiods (a) and (b), respectively.

The cylinder identification can be performed on the basis of combination(s) of the pulse numbers of the cam pulse signal detected during the subperiods (a) and (b), respectively. Simultaneously, the information series learning means 16 performs learning of the cam signal pulse trains for identifying the engine cylinders by making use of the learned pulse trains when the phase of the cam pulse signal changes owing to the variable valve timing control.

Referring to FIG. 13, it is presumed that the timing operations of the unknown flag F_unk(n), the crank pulse counter C_sgt, the cam signal pulse train S_cam(n), the identified cylinder Cyld(n) and the current cylinder Cylp(n), respectively, are same as those described previously by reference to FIGS. 5 and 7.

At first, at the time point tA, the cylinder identifying means 10 identifies "cylinder #1" on the basis of the pulse numbers "1" and "0" in the subperiods (a) and (b), respectively, by referencing the table shown in FIG. 3. At the same time, the information series learning means 16 fetches for storage the pulse trains S_cam(n−1) and S_cam(n) of "1" and "1" of the cam pulse signal, as the learned pulse trains, respectively.

Further, at the time point tB, the cylinder identifying means 10 identifies "cylinder #3" on the basis of the pulse numbers "2" and "1" in the subperiods (a) and (b), respectively, by referencing the table shown in FIG. 3. At the same time, the information series learning means 16 fetches for storage the pulse trains S_cam(n−1) and S_cam(n) of "0" and "2" of the cam pulse signal as the learned pulse trains, respectively.

Furthermore, at the time point tC, the cylinder identifying means 10 identifies "cylinder #4" on the basis of the pulse numbers "0" and "2" in the subperiods (a) and (b), respectively, by referencing the table shown in FIG. 3. At the same time, the information series learning means 16 fetches for storage the pulse trains S_cam(n−1) and S_cam(n) of "0" and "2" of the cam pulse signal as the learned pulse trains, respectively.

Besides, at the time point tD, the cylinder identifying means 10 identifies "cylinder #2" on the basis of the pulse numbers "0" and "1" in the subperiods (a) and (b) by referencing the table shown in FIG. 3, respectively. At the same time, the information series learning means 16 fetches for storage the pulse trains S_cam(n−1) and S_cam(n) of "0" and "2" of the cam pulse signal as the learned pulse trains, respectively.

FIG. 14 shows a cylinder identification table based on the cam signal pulse trains S_cam(n−1) and S_cam(n) detected at the crank angle positions corresponding to the time points tA to tD, respectively. This figure corresponds to FIG. 3 mentioned hereinbefore.

FIG. 15 shows a table for illustrating the SGC pulse trains S_cam(n−3), S_cam(n−2), S_cam(n−1) and S_cam(n) at the cylinder identification crank angle positions learned as described previously by reference to FIG. 14.

Referring to FIG. 15, the SGC pulse trains corresponding to a1, b1, c1 and d1, respectively, represent the information series in the state in which the phase of the variable valve timing is most retarded, while the SGC pulse trains corresponding to a2, b2, c2 and d2, respectively, represent the information series in the case where the phase of the valve drive timing is most advanced under the effect of the variable valve timing control.

Of the information series shown in FIG. 15, the two pulse trains S_cam(n−1) and S_cam(n) represent the pulse trains S_cam(n−1) and S_cam(n) of "1" and "1", respectively, for the cylinder #1 shown in FIG. 14.

Further, the remaining cam pulses S_cam(n−3) and S_cam(n−2) of the information series al necessarily assume the values (pulse numbers) based on the waveforms shown in FIG. 13 when the learned values for the cylinder #1 are given by S_cam(n−1)="1" and S_cam(n)="1", respectively.

On the other hand, in the information series a2 which may occur in the most advanced phase of the cam pulse signal, the valve drive timing phase advanced under the effect of the variable valve timing control is on the order of 60° CA at maximum. Accordingly, the cam signal pulse trains S_cam (n−3), S_cam(n−2), S_cam(n−1) and S_cam(n) will be, for example, as follows.

Namely, the pulse trains S_cam(n−3), S_cam(n−2), S_cam(n−1) of the information series a2 assume the values "0", "1" and "1" of the pulse trains S_cam(n−2), S_cam (n−1) and S_cam(n) of the information series a1 while the pulse train S_cam(n) of the series a2 will necessarily assume the value "0" in correspondence to the pulse trains S_cam(n−3), S_cam(n−2) and S_cam(n−1) for the cylinder #1.

By referencing the table shown in FIG. 15 which results from the learning procedure mentioned above, it can be identified that the current cylinder Cyld(n) is the "cylinder #1" and that the cylinder Cylp(n) to be next identified is currently the "cylinder #3", because the SGC pulse trains S_cam(n−3), S_cam(n−2), S_cam(n−1) and S_cam(n) are "2", "0", "1" and "1", (or alternatively "0", "1", "1" and "0"), respectively.

In the foregoing, description has been made of the learn processing only for the information series a1 and a2 representatively by reference to FIG. 5, it should be appreciated that the learn processings for the other information series b1, b2, c1, c2, d1 and d2 are executed through similar procedure.

Figure 16:
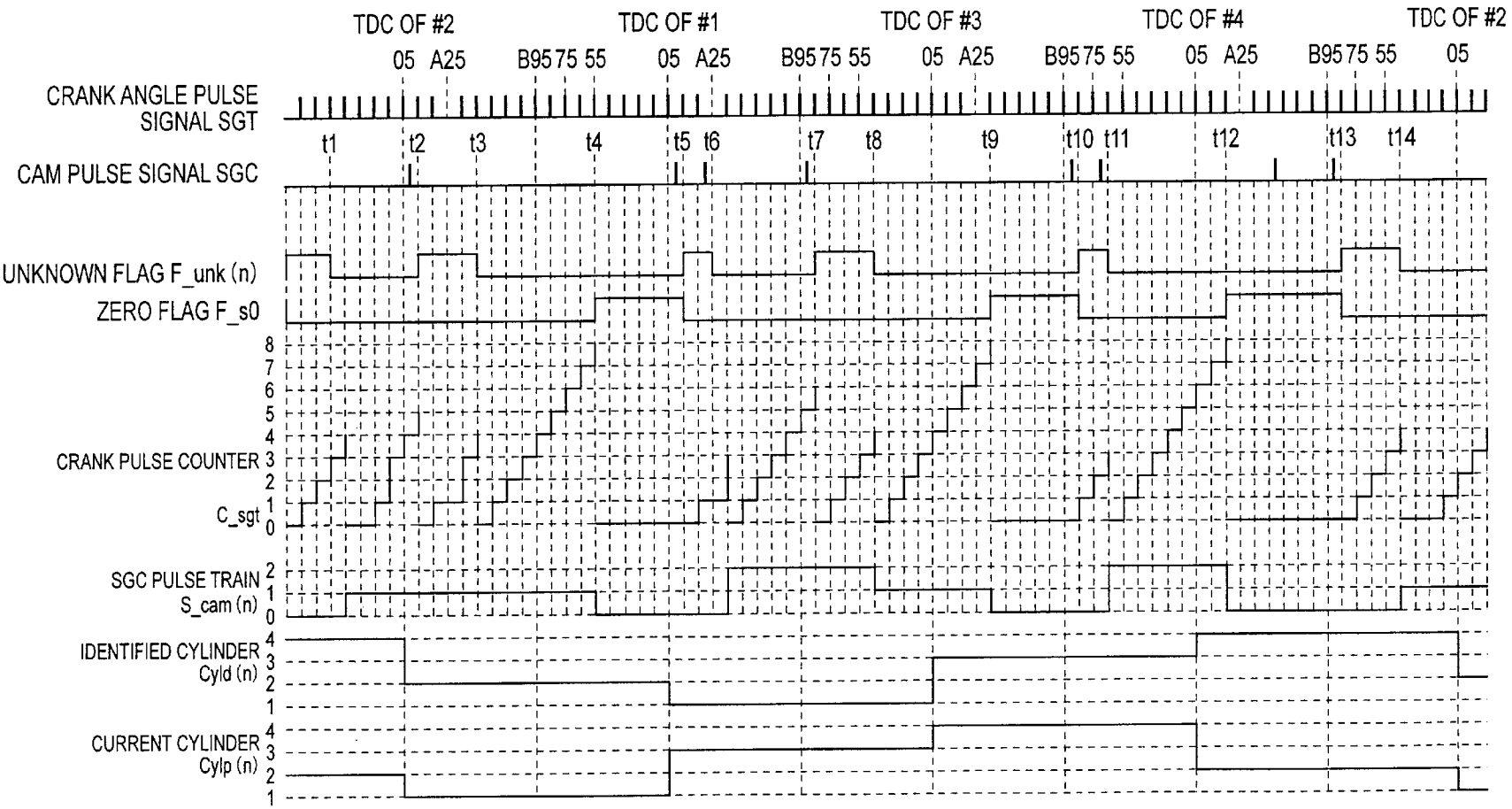
FIG. 16 is a timing chart for illustrating various pulse signal patterns during operation of the variable valve timing control in the case where mounting error of a cam signal sensor is taken into account in the cylinder identifying system according to the first embodiment of the invention.

FIG. 16 is a timing chart for illustrating various pulse signal patterns in the case where the valve drive timing phase (SGC phase) is most advanced due to the variable valve timing control in the crank angle pulse signal SGT and the cam pulse signal SGC in which the phase difference dispersion (mounting error of the cam signal sensor) is taken into consideration, as described hereinbefore by reference to FIG. 13. In this case, the cylinder identification processing operation is carried out in the similar manner as described hereinbefore. Accordingly, repetitive description thereof will be unnecessary.

Figure 17:
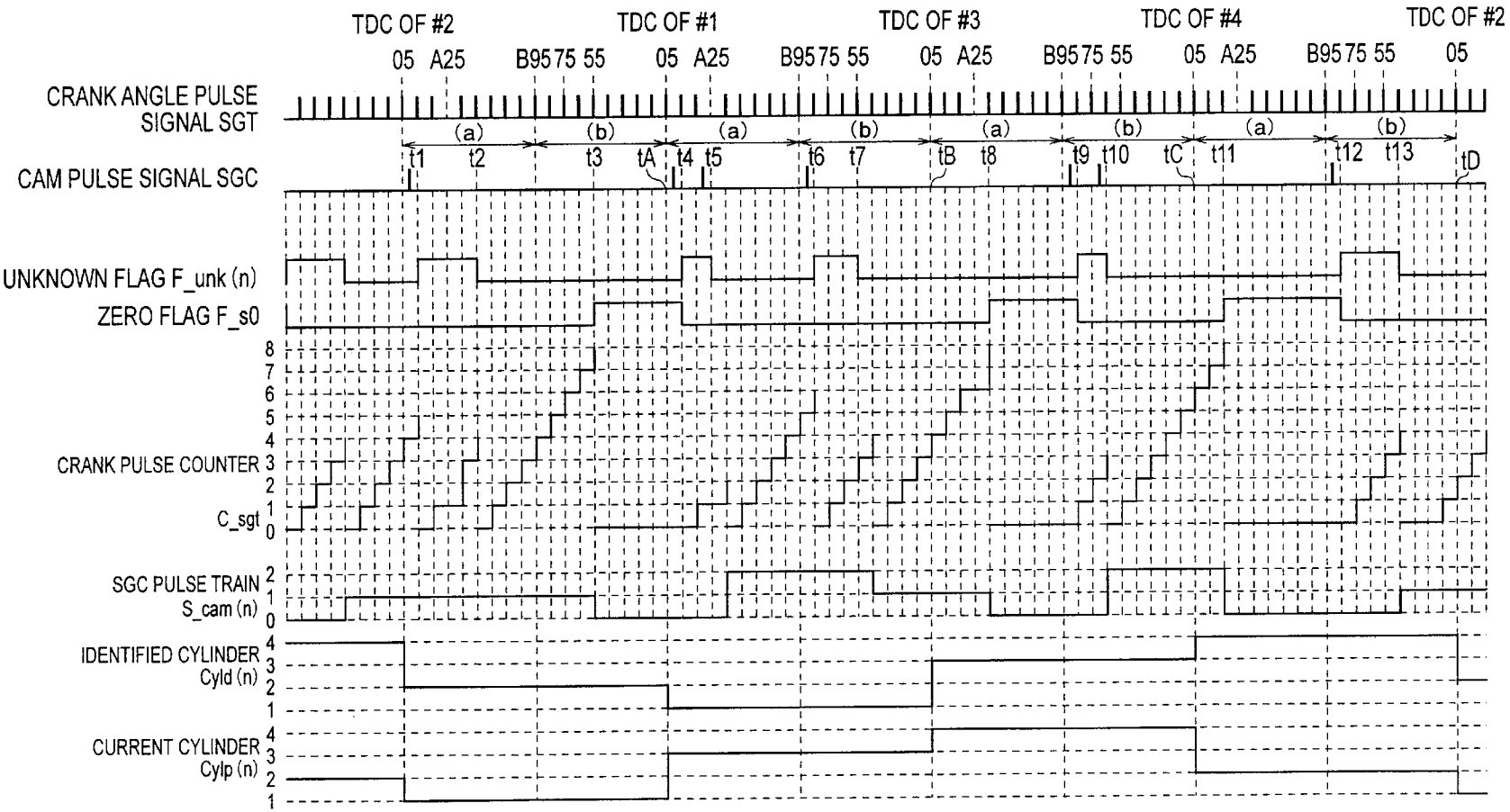
FIG. 17 is a timing chart showing various pulse signal patterns in the case where the cam signal pulse is in the most retarded state and in which the mounting error of a cam signal sensor is taken into in the cylinder identifying system according to the first embodiment of the invention.

FIG. 17 is a timing chart showing the various pulse signal patterns in the case where the valve drive timing phase is most retarded under the effect of the variable valve timing control, wherein phase dispersion of the cam pulse signal SGC relative to the crank angle pulse signal SGT is deviated at maximum to the advanced side.

Referring to FIG. 17, the cam signal pulse trains S_cam (n−1) and S_cam(n) detected at every position B05 of the individual cylinders are such as shown in the cylinder identification table of FIG. 18 as in the case mentioned previously by reference to FIG. 13.

Accordingly, by performing the learn processing for the four successive cam signal pulse trains S_cam(n−3), S_cam(n−2), S_cam(n−1) and S_cam(n) by referencing the table shown in FIG. 18 which is based on the pulse pattern illustrated in FIG. 17, there can be obtained the cylinder identification table shown in FIG. 19.

Figure 20:
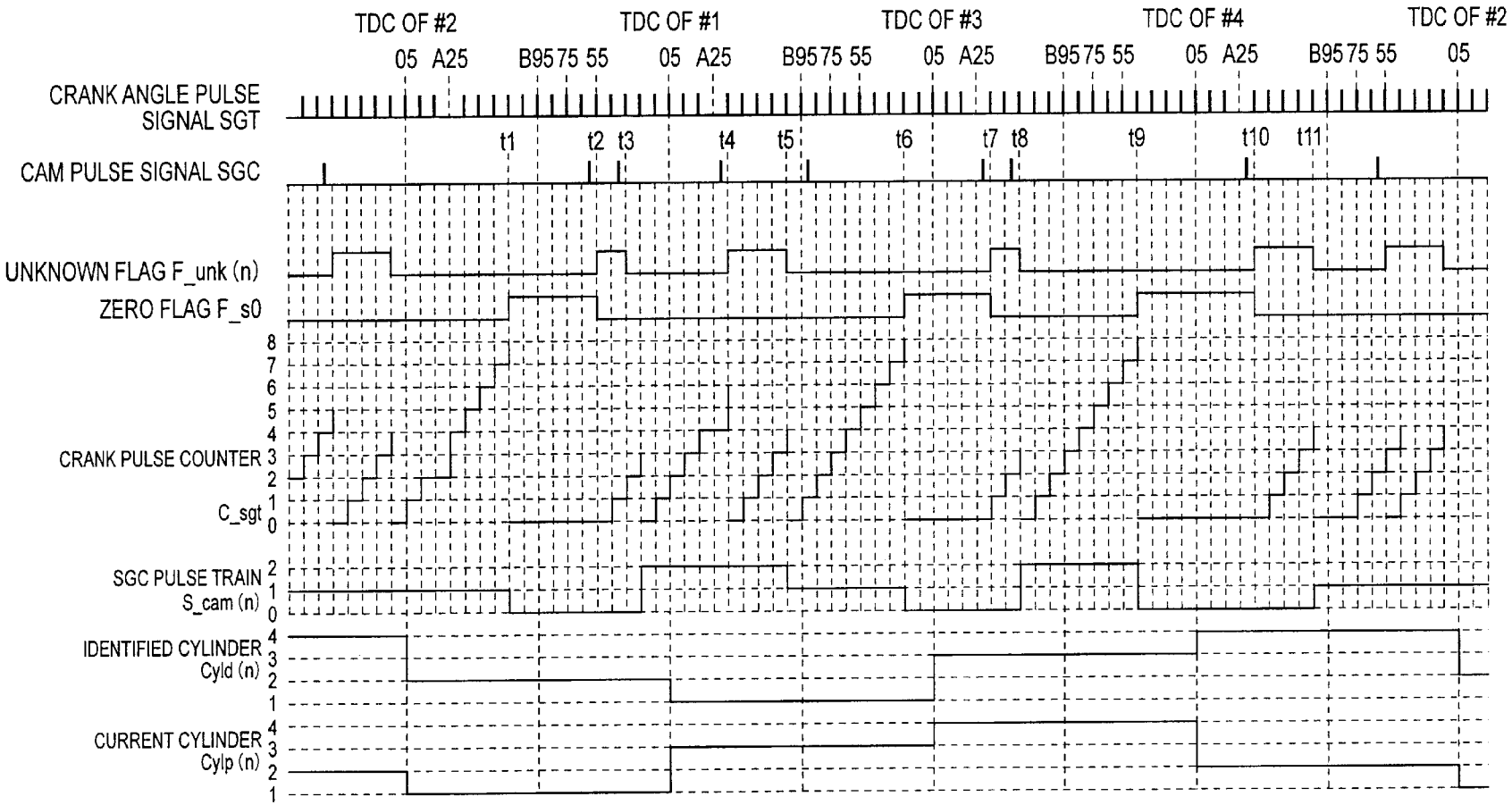
FIG. 20 is a timing chart showing pulse signal patterns and a cylinder identifying operation in the case where the cam pulse signal is caused to advance through the variable valve timing control, as is shown in FIG. 17.

FIG. 20 is a timing chart showing pulse signal patterns in the case where the cam pulse signal SGC undergone a maximum phase shift relative to the crank angle pulse signal SGT is caused to advance under the effect of the variable valve timing control, as shown in FIG. 17. This figure also illustrates the cylinder identification processing operation carried out by using the crank angle pulse signal SGT and the cam pulse signal SGC similarly to the cases described hereinbefore.

By executing the cam signal pulse train learn processing in the specific operating states, as described above by reference to FIGS. 13 to 20, it is possible to learn the changes of the cam signal pulse trains (SGC pulse trains) which are brought about when the valve drive timing phase is caused to change through the variable valve timing control, whereby the cylinder identification can be performed with high accuracy even when the detected phase difference of the cam pulse signal SGC relative to the crank angle pulse signal SGT should vary or disperse for the cases such as the mounting installation error of the cam shaft sensor or the like.

Further, since the information series storage means 15 is designed to store two types of information series each composed of the four successive cam signal pulse trains within the range in which the timing of the cam pulse signal SGC changes, the specific cylinder identification can be realized even when the valve drive timing phase should change (toward the most advanced position) under the effect of the valve timing control. In that case, the information of the cam signal pulse trains may be stored in a given number of times (more than four times inclusive thereof).

Although the foregoing description has been made on the presumption that the learn processing is executed when the valve drive timing phase (SGC phase) is most retarded due to the variable valve timing control, it should be appreciated that the learn processing may be executed not only when the valve drive timing phase is most retarded but also when the valve drive timing phase is most advanced or alternatively when the engine operation is started.

Furthermore, by virtue of the arrangement that the cylinder identifying means 10 is so designed as to detect the crank angle position from the crank angle pulse signal SGT at every predetermined crank angle (10° CA) including the reference position A35 and perform cylinder identification on the basis of combination of the pulse output numbers of the cam pulse signal SGC during the plural subperiods (a) and (b) of the ignition TDC period, the cylinder identification can speedily and swiftly be accomplished when the operation of the internal combustion engine is started.

In other words, by virtue of the feature that the cylinder identification can be realized on the basis of the cam signal pulse trains capable of being set in the complicated patterns, the cylinder identification can be carried out without being limited only to any particular detection period, which means in turn that the time equivalent to the rotation angle which is required for the cylinder identification can be decreased, whereby the engine start performance can be significantly enhanced.

In this conjunction, it is also to be noted that the cylinder identifying means 10 is capable of identifying discriminatively the individual cylinders at least either during a predetermined period from the engine start or when the valve timing is most retarded by the variable valve timing means 5. In that case, there is no need for taking into consideration the change or shift of the phase due to the variable valve timing control. Thus, the cylinder identification can be accomplished accurately provided that the information series storage means 15 stores therein only the single cam signal pulse train.

It should further be added that since the phase detecting means 6 for detecting the phase change brought about by the variable valve timing control on the basis of the crank angle pulse signal SGT, the cam pulse signal SGC and the information series is provided in association with the cylinder identifying means 10, there is no necessity of providing the valve drive timing phase sensor in the vicinity of the cam shaft 2. By virtue of this feature, the system configuration can be simplified with high freedom in design being ensured. Besides, the cylinder identifying system can be implemented at low cost.

Embodiment 2

The foregoing description directed to the first embodiment of the present invention has been made on the presumption that the invention is applied to the four-cylinder internal combustion engine. A second embodiment of the present invention is concerned with the cylinder identifying system which can be applied to a six-cylinder internal combustion engine substantially to the same advantageous effects.

Figure 21:
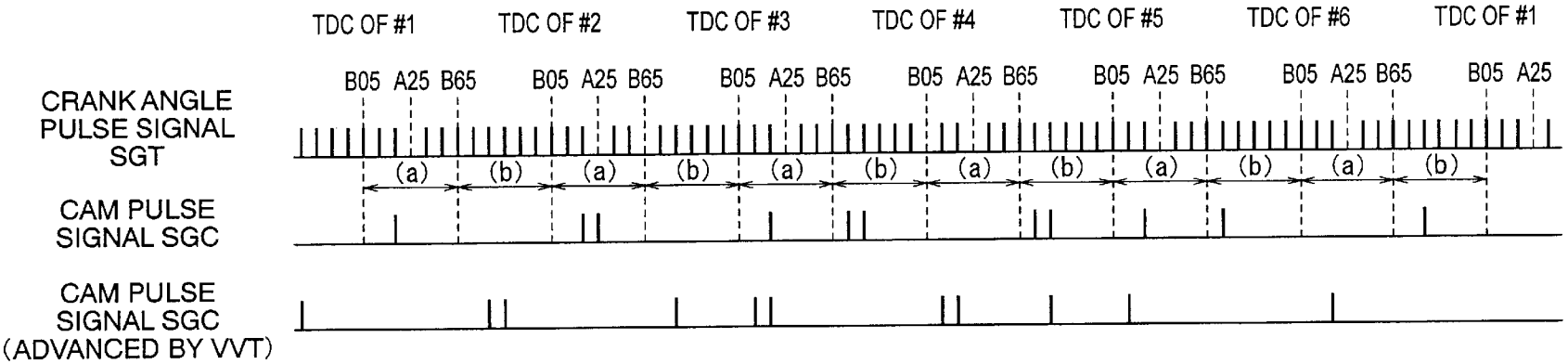
FIG. 21 is a timing chart showing pulse patterns generated in a six-cylinder engine according to a second embodiment of the present invention.

FIG. 21 is a timing chart showing pulse generation patterns of the crank angle pulse signal SGT and the cam pulse signal SGC generated in the cylinder identifying system according to the second embodiment of the invention applied to the six-cylinder engine.

Referring to FIG. 21, the tooth dropout position for each cylinder is set at the crank position A25, as in the case of the first embodiment. However, in the six-cylinder internal combustion engine, the TDC period (i.e., ignition control period) extends over 120° CA. Consequently, the subperiod (a) ranges from B05 to B65 while the subperiod (b) ranges from B65 to B05.

Parenthetically, the numbers of the specific pulses contained in the cam pulse signal SGC generated during the subperiods (a) and (b), respectively, are so set as to be "1" and "0"; "2" and "0"; "1" and "2"; "0" and "2"; "1" and "1"; and "0" and "1", respectively, in the sequential order in which the individual cylinders are controlled.

In that case, in the crank angle pulse signal SGT, the reference position or signal (dropout tooth position) is set for every 120° CA and the pulse trains of the cam pulse signal SGC are arrayed in correspondence to the subperiods (a) and (b).

FIG. 22 is a view for illustrating a cylinder identification table based on combinations of the numbers of the cam signal pulses generated during the subperiods (a) and (b), respectively.

By referencing the table data shown in FIG. 22 in conjunction with the pulse signal patterns illustrated in FIG. 21, the cylinder identification can be realized at the crank rotation angle of 120° CA at minimum and 180° CA at maximum.

FIG. 23 is a view for illustrating the cam signal pulse trains S_cam(n−1) and S_cam(n) detected at the time point at which the phase of the cam pulse signal or valve drive timing phase is most retarded in the pulse signal patterns shown in FIG. 21.

In this case, the detection processings for the cam signal pulse trains are also similar to those described hereinbefore. Accordingly, repetitive description thereof will be unnecessary. However, since the crank angle interval of the top dead center period (from B05 to B05) differs, the conditions for the crank pulse counter C_sgt for determining discriminatively the cam signal pulse train differ from those described hereinbefore.

FIG. 24 is a view for illustrating a cylinder identification table based on the cam signal pulse trains S_cam(n−3), S_cam(n−2), S_cam(n−1) and S_cam(n) learned from the result of detection illustrated in FIG. 23.

As can be seen in FIG. 24, the cylinder identification can be realized on the basis of the cam signal pulse trains S_cam(n−3), S_cam(n−2), S_cam(n−1) and S_cam(n) even when the cam pulse signal phase is caused to change under the effect of the variable valve timing control in the six-cylinder engine employing the variable valve timing system.

Embodiment 3

In the case of the second embodiment of the present invention, the cylinder identifying system is applied to the six-cylinder internal combustion engine. A third embodiment of the present invention is directed to the cylinder identifying system applied to a three-cylinder internal combustion engine for realizing the similar advantageous effects as those mentioned hereinbefore.

Figure 25:
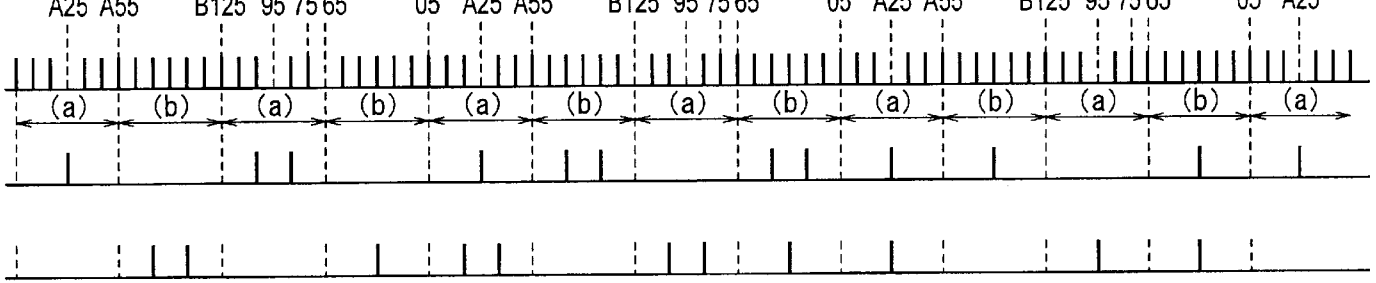
FIG. 25 is a timing chart showing pulse patterns generated in a three-cylinder engine according to a third embodiment of the present invention.

FIG. 25 is a timing chart showing pulse generation patterns of the crank angle pulse signal SGT and the cam pulse signal SGC generated in the cylinder identifying system according to the third embodiment of the invention applied to the three-cylinder engine.

In this case, a reference position (pulse dropout position) is set at every 120° CA in the crank angle pulse signal SGT similarly to the case of the six-cylinder engine, whereby the reference signals are generated twice during the top dead center (TDC) period (240° CA).

Although the top dead center period of the three-cylinder engine is 240° CA, a same crank angle signal SGT is outputted every one rotation of the engine (360° CA). Thus, the reference signals can not be outputted three times during a period corresponding to two engine rotations (720° CA).

Discriminative determination of the subperiods (a) and (b) can be made on the basis of presence/absence of the reference signal in each of subperiods resulting from division of the period extending from B05 to B05 of the cam pulse signal SGC by four (i.e., corresponding to the division of the reference signal period of 120° CA by two). The cam pulse (SGC) trains of the pulse number "0", "1" or "2" are arrayed in the individual subperiods (a) and (b) described similarly to the cases hereinbefore.

In the case of the instant embodiment of the invention, the numbers of the specific pulses contained in the cam pulse signal SGC generated during the subperiods (a) and (b), respectively, are so set as to be "1", "0", "2" and "0"; "1", "2", "0" and "2"; "1", "1", "0" and "1", respectively, in the sequential order in which the cylinders are controlled.

FIG. 26 is a view showing a cylinder identification table in the case of the cylinder identifying system applied to the three-cylinder internal combustion engine, which corresponds to that shown in FIG. 22 described hereinbefore.

By referencing the table data of FIG. 26 on the basis of combination of the cam signal pulse trains in the individual subperiods (a) and (b) at the end point of the subperiod (b) shown in FIG. 25, the specific cylinder and the specific crank angle position are determined discriminatively.

FIG. 27 is a view for illustrating the cam signal pulse trains S_cam(n−1) and S_cam(n) detected at the end point of the subperiod (b) at the time point at which the valve drive timing phase is most retarded in the pulse signal patterns shown in FIG. 25. This figure corresponds to those shown in FIG. 23.

The detection processings for the cam signal pulse trains S_cam(n−1) and S_cam(n) shown in FIG. 27 are similar to those described hereinbefore.

FIG. 28 is a view for illustrating a cylinder identification table based on the cam signal pulse trains S_cam(n−3), S_cam(n−2), S_cam(n−1) and S_cam(n) learned from the result of detection shown in FIG. 23. This figure corresponds to the one shown in FIG. 24.

Parenthetically, the cylinder identification can be realized at the timings corresponding to the position B05 of the individual cylinders also in the three-cylinder engine equipped with the variable valve timing mechanism.

Referring to FIG. 28, the pulses S_cam(n−3) and S_cam (n−2) of the learned information series a1 correspond to the pulse trains S_cam(n−1) and S_cam(n) (i.e., zero-pulse train and single-pulse train, respectively) at the position B125 of the cylinder #1 shown in FIG. 27, while the pulse trains S_cam(n−1) and S_cam(n) of the learned cam pulse information series a1 correspond to the pulse trains S_cam (n−1) and S_cam(n) (i.e., single-pulse train and zero-pulse train, respectively) at the position B05 of the cylinder #1 shown in FIG. 27.

Further, the pulse S_cam(n−3) of the learned information series a2 shown in FIG. 28 corresponds to the pulse train S_cam(n) (i.e., single-pulse train) at the position B125 of the cylinder #1 shown in FIG. 27, the pulse trains S_cam (n−2) and S_cam(n−1) of the learned information series a2 correspond to the pulse trains S_cam(n−1) and S_cam(n) (i.e., single-pulse train and zero-pulse train, respectively) at the position B05 of the cylinder #1 of FIG. 27, and the pulse train S_cam(n) of the learned information series a2 corresponds to the pulse train S_cam(n−1) (i.e., two-pulse train) at the position B125 of the cylinder #3 shown in FIG. 27. Same holds true to the other learned information series b1, b2, c1 and c2.

Many features and advantages of the present invention are apparent from the detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described. Accordingly, all suitable modifications and equivalents may be resorted to, falling within the spirit and scope of the invention.

What is claimed is:

1. A cylinder identifying system for an internal combustion engine, comprising:

crank angle signal generating means provided in association with a crank shaft of said internal combustion engine for generating a crank angle pulse signal in synchronization with rotation of said crank shaft of said engine;

cam signal generating means provided in association with a cam shaft for generating a cam pulse signal containing specific pulses for identifying individual cylinders of said internal combustion engine in synchronization with rotation of said cam shaft rotating at a speed corresponding to one half of that of said crank shaft;

variable valve timing means for setting variably the phase of valve drive timing for said individual cylinders, respectively, in dependence on operating states of said engine; and cylinder identifying means designed for operating in synchronization with the phase of said valve drive timing for said individual cylinders which is changed by said variable valve timing means, for thereby identifying discriminatively said individual cylinders on the basis of said crank angle pulse signal and said cam pulse signal, wherein said cylinder identifying means includes:

pulse signal number storage means for counting for storage signal numbers of said specific pulses generated over a plurality of subperiods which are defined by dividing an ignition control period for each of said individual cylinders into plural subperiods; and information series storage means for storing information series composed of a combination of the signal numbers of said specific phases generated during said plural subperiods, respectively;

wherein said individual cylinders of said internal combustion engine are identified on the basis of said information series.

2. A cylinder identifying system for an internal combustion engine according to claim 1, wherein said information series is composed of four successive signals containing said specific pulses.

3. A cylinder identifying system for an internal combustion engine according to claim 1, wherein said information series storage means is so designed as to store a plurality of information series which are variable within a range in which the phase of said valve drive timing is changed by said variable valve timing means, and wherein said cylinder identifying means identifies a given one of said cylinders on the basis of at least one of said plural information series.

4. A cylinder identifying system for an internal combustion engine according to claim 1, wherein said cylinder identifying means includes:

information series learning means for learning a first one of said information series at a predetermined crank angle based on said crank angle pulse signal, wherein said cylinder identifying means is so arranged as to identify said individual cylinders on the basis of a result of comparison of the information series detected currently with said first information series learned.

5. A cylinder identifying system for an internal combustion engine according to claim 4, wherein said cylinder identifying means includes:

changeable information series arithmetic means for determining arithmetically a second one of said information series which can vary within a range of said predetermined crank angle on the basis of said first information series and the range within which the phase of said valve drive timing can be changed by means of said variable valve timing means, and wherein said cylinder identifying means is so arranged as to identify said individual cylinders, respectively, on the basis of result of comparison between the information series detected currently and at least one of said first and second information series.

6. A cylinder identifying system for an internal combustion engine according to claim 4, wherein said information series learning means is so arranged as to learn said first information series at a time point which corresponds to at least one of a most retarded valve drive timing and a most advanced valve drive timing set by said variable valve timing means.

7. A cylinder identifying system for an internal combustion engine according to claim 4, wherein said information series learning means is so arranged as to learn said first information series at a time point at which operation of said internal combustion engine is started.

8. A cylinder identifying system for an internal combustion engine according to claim 1, wherein said crank angle pulse signal is comprised of pulse trains each containing a pulse indicative of a reference position for each of said individual cylinders, and wherein said plural subperiods are established by dividing said ignition control period with reference to said reference position.

9. A cylinder identifying system for an internal combustion engine according to claim 8, wherein said cylinder identifying means is so arranged as to identify said individual cylinders at least either during a predetermined time period from a time point at which said engine operation is started or at a time point corresponding to said most retarded valve drive timing set by said variable valve timing means.

10. A cylinder identifying system for an internal combustion engine according to claim 1, further comprising:

phase detecting means for detecting a change of the valve drive timing phase shifted by means of said variable valve timing means on the basis of given specific pulses contained in said cam pulse signal and crank angle position information derived from said crank angle pulse signal.

11. A cylinder identifying system for an internal combustion engine according to claim 1, wherein the number of the cylinders of said internal combustion engine is four and the ignition control period for each of said cylinders is so set as to correspond to a crank angle of 180°, said plural subperiods corresponding to each of said individual cylinders being constituted by a first subperiod and a second subperiod, respectively, and wherein the numbers of said specific pulses contained in said cam pulse signal generated during said first subperiod and said second subperiod, respectively, are "1" and "0"; "2" and "1"; "0" and "2"; and "0" and "1", respectively, in the sequential order in which said cylinders are controlled.

12. A cylinder identifying system for an internal combustion engine according to claim 1, wherein the number of the cylinders of said internal combustion engine is six and the ignition control period for each of said cylinders is so set as to correspond to a crank angle of 120°, said plural subperiods corresponding to said individual cylinders being constituted by a first subperiod and a second subperiod, respectively, and wherein the numbers of said specific pulses contained in said cam pulse signal generated during said first subperiod and said second subperiod, respectively, are "1" and "0", "2" and "0", "1" and "2", "0" and "2", "1" and "1" and "0" and "1", respectively, in the order in which said cylinders are to be controlled.

13. A cylinder identifying system for an internal combustion engine according to claim 1, wherein the number of the cylinders of said internal combustion engine is three and the ignition control period for each of said cylinders is so set as to correspond to a crank angle of 240°, said plural subperiods being constituted by a first subperiod, a second subperiod, a third subperiod and a fourth subperiod, respectively, wherein the numbers of said specific pulses contained in said cam pulse signal during said first, second, third and fourth subperiods, respectively, are "1", "0", "2" and "0"; "1", "2", "0" and "2"; "1", "1", "0" and "1", respectively, in the sequential order in which said individual cylinders are controlled.

* * * * *